US010723002B1

(12) United States Patent
Good

(10) Patent No.: US 10,723,002 B1
(45) Date of Patent: Jul. 28, 2020

(54) INLINE CLAMP SYSTEM

(71) Applicant: KREG ENTERPRISES, INC., Huxley, IA (US)

(72) Inventor: Frederick James Good, Ogden, IA (US)

(73) Assignee: KREG ENTERPRISES, INC., Huxley, IA (US)

( * ) Notice: Subject to any disclaimer, the term of this patent is extended or adjusted under 35 U.S.C. 154(b) by 176 days.

(21) Appl. No.: 15/916,474

(22) Filed: Mar. 9, 2018

Related U.S. Application Data

(60) Provisional application No. 62/470,731, filed on Mar. 13, 2017.

(51) Int. Cl.

| | |
|---|---|
| ***B25B 9/00*** | (2006.01) |
| ***B25B 5/16*** | (2006.01) |
| ***B25H 1/08*** | (2006.01) |
| ***B25B 5/02*** | (2006.01) |

(52) U.S. Cl.
CPC ..... *B25B 5/166* (2013.01); *B25B 5/02* (2013.01); *B25H 1/08* (2013.01)

(58) Field of Classification Search
CPC ..... B23P 11/00; B23P 11/005; B23P 19/00; B23P 19/02; B23Q 3/00
See application file for complete search history.

(56) References Cited

U.S. PATENT DOCUMENTS

| | | | | |
|---|---|---|---|---|
| 4,765,048 | A * | 8/1988 | Hokanson | B25B 27/023 29/221.5 |
| 4,840,387 | A | 6/1989 | McCarthy | |
| 5,090,102 | A * | 2/1992 | Lovell | B25B 27/06 29/255 |
| 5,890,271 | A * | 4/1999 | Bromley | B25B 27/0028 29/255 |

* cited by examiner

*Primary Examiner* — Lee D Wilson
(74) *Attorney, Agent, or Firm* — Christopher A. Proskey; BrownWinick Law Firm

(57) ABSTRACT

An inline clamp system having a base, a shoe having a plurality of teeth and a scroll wheel having a helical feature on a cone shaped surface. The helical feature of the scroll wheel meshes with the teeth of the shoe such that rotation of the scroll wheel in a first rotational direction causes linear movement of the shoe in a first linear direction and rotation of the scroll wheel in a second rotational direction causes linear movement of the shoe in a second linear direction, the first rotational direction being opposite the second rotational direction and the first linear direction being opposite the second linear direction. The scroll wheel rotates around an axis of rotation at a slight angle to the linear plane of movement of the shoe such that the helical feature engages the teeth only on one side of the axis of rotation.

41 Claims, 40 Drawing Sheets

18

18

10

10

INLINE CLAMP SYSTEM

CROSS REFERENCE TO RELATED APPLICATIONS

This application claims benefit from U.S. Patent and Trademark Office Provisional Application No. 62/470,731 which was filed Mar. 13, 2017, the entirety of which is fully incorporated herein by reference.

FIELD OF THE DISCLOSURE

This disclosure relates generally to clamps. More specifically and without limitation, this disclosure relates to a clamp system that has a number of features that provides new and unique functionality.

BACKGROUND OF THE DISCLOSURE

Clamps are well known in the art. There are many forms of clamps that are used to hold a workpiece in a stationary position so that an operation may be performed on the workpiece.

One well-known clamp design is known as a C-clamp. C-clamps include an upper arm and a lower arm that are connected to an operating mechanism, such as a handle that is used to tighten the upper arm and the lower arm against one another. In use, the upper arm is placed on an upper surface of the workpiece and the lower arm is placed on the lower surface of a benchtop, work bench or support surface that supports the workpiece (hereinafter "support surface"). Once in place, the operating mechanism is used to tighten the upper arm against the lower arm thereby holding the workpiece in a stationary position on the support surface.

While C-clamps are effective, they suffer from many disadvantages. One such disadvantage is that the conventional C-clamps have a limited reach which restricts their use to be near the edge of a support surface. As such, C-clamps cannot be used for many applications. Another disadvantage is that C-clamps are relatively difficult and time consuming to operate. As such, C-clamps are undesirable in many applications and for many users. Another disadvantage to C-clamps is that the upper arm covers a portion of the surface of the workpiece when the workpiece is clamped in place. This prevents certain operations such as sanding the entire upper surface of the workpiece. As such, C-clamps suffer from many disadvantages and are not suitable in many applications.

Another well-known clamp design is known as a bar clamp. Bar clamps, like C-clamps, include an upper arm, and a lower arm that are connected to an operating mechanism, such as a handle that is used to tighten the upper arm and the lower arm against one another. Unlike C-clamps, bar clamps include an elongated bar that allows for an increased travel between the upper arm and the lower arm. The elongated bar allows the bar clamp to clamp longer items.

While bar clamps facilitate clamping longer items, bar clamps suffer from many of the same deficiencies as C-clamps. One such disadvantage is that the bar clamps have a limited reach which restricts their use to be near the edge of a support surface. Another disadvantage is that bar clamps are relatively difficult and time consuming to operate and can be cumbersome to use due to the elongated bar. Another disadvantage is that the upper arm covers a portion of the surface of the workpiece when the workpiece is clamped in place which can prevent various operations such as sanding.

As such, bar clamps suffer from many disadvantages and are not suitable in many application.

Another well-known clamp design is known as a bench clamp. Bench clamps, like bar clamps and C-clamps, clamp a workpiece against a support surface by pressing the workpiece against the support surface. Unlike bar clamps and C-clamps, bench clamps only include an upper arm and connect to the support surface through a connecting device such as a screw, bolt, post or other mechanism that connects to an opening, slot or feature in the support surface. Through the bench clamp's connection to the support surface, the bench clamp essentially replaces the lower arm with the support surface and presses the workpiece into the support surface. This connection between the bench clamp and the support surface allows for placement of the bench clamp wherever the bench clamp can connect to the support surface, which can in some applications, facilitate clamping in positions not accessible to bar clamps or C-clamps.

While bench clamps have some advantages over bar clamps or C-clamps, bench clamps suffer from many of many of the same deficiencies as bar clamps and C-clamps. One such disadvantage is that the bench clamps generally operate to press a workpiece into the work surface and therefore the upper arm of the bench clamp covers a portion of the surface of the workpiece when the workpiece is clamped in place which can prevent various operations such as sanding. In addition, bench clamps are relatively difficult and time consuming to operate due to the pressure required to clamp the workpiece against the support surface.

A lesser known form of a clamp or clamp design is known as a linear clamp, an in line clamp, a toggle clamp or a push clamp (hereinafter "push clamp"). Push clamps are similar to bench clamps in that they connect to the support surface and only include a single arm. Push clamps differ from C-clamps, bar clamps and bench clamps in that they only include a single arm that is configured to push a workpiece against another object, such as a stop member placed on a support surface. In this way, push clamps do not apply down pressure on the workpiece and therefore they do not encumber the upper surface of the workpiece in the same way that C-clamps, bar clamps and bench clamps do.

Various forms of push clamps are manufactured. Among others, these include:

- The "Auto-Pro P7-IL In-Line Dog Clamp" manufactured by Armor Tool, LLC having an address of 4001 West Indian School Road, Phoenix, Ariz. 85019;
- The "Auto-Lock T-Track Clamp" manufactured by Rockler Woodworking and Hardware having an address of 4365 Willow Drive, Medina, Minn. 55340;
- The "Panel Clamp" manufactured by Veritas® Tools Inc. having an address of 1090 Morrison Dr., Ottawa, Ontario, Canada, K2H 1C2;
- The "Clamping Elements 2-Pack—488030" manufactured by Festool Group GmbH & Co. KG based in Wendlingen, Germany, and is a subsidiary of TTS Tooltechnic Systems holding company.

While these push clamps provide certain benefits over C-clamps, bar clamps and bench clamps, the presently available push clamps suffer from many disadvantages. Namely, the presently available push clamps are unnecessarily or prohibitively expensive, which is due in part to their design and configuration. In addition, the presently available push clamps are not convenient to use, comfortable to use or intuitive to use. Another disadvantage of the presently available push clamps is that, due in part to their design and configuration they are not applicable in various applications.

Therefore, for all the reasons stated above, and the reasons stated below, there is a need in the art for an inline clamp system that improves upon the state of the art.

Another object of the disclosure is to provide an inline clamp system that provides improved functionality over prior art clamps.

Yet another object of the disclosure is to provide an inline clamp system that provides improved features over prior art clamps.

Another object of the disclosure is to provide an inline clamp system that is relatively inexpensive.

Yet another object of the disclosure is to provide an inline clamp system that is easy to use.

Another object of the disclosure is to provide an inline clamp system that is intuitive to use.

Yet another object of the disclosure is to provide an inline clamp system that is strong and robust.

Another object of the disclosure is to provide an inline clamp system that can be used in many applications.

Yet another object of the disclosure is to provide an inline clamp system that can be used with practically any support surface or workbench.

Another object of the disclosure is to provide an inline clamp system that provides unique functionality.

Yet another object of the disclosure is to provide an inline clamp system that is fast to use.

Another object of the disclosure is to provide an inline clamp system that is safe to use.

Yet another object of the disclosure is to provide an inline clamp system that saves time.

Another object of the disclosure is to provide an inline clamp system that has a compact size.

Yet another object of the disclosure is to provide an inline clamp system that has a low profile.

Another object of the disclosure is to provide an inline clamp system that has a long useful life.

Yet another object of the disclosure is to provide an inline clamp system that can be used to clamp straight workpieces as well as inside corners and outside corners.

Another object of the disclosure is to provide an inline clamp system that is high quality.

Yet another object of the disclosure is to provide an inline clamp system that improves efficiencies.

Another object of the disclosure is to provide an inline clamp system that is fun to use.

Yet another object of the disclosure is to provide an inline clamp system that improves the quality of the products made using the device.

These and other objects, features, or advantages of the disclosure will become apparent from the specification, figures and claims.

SUMMARY OF THE DISCLOSURE

Figure 1:
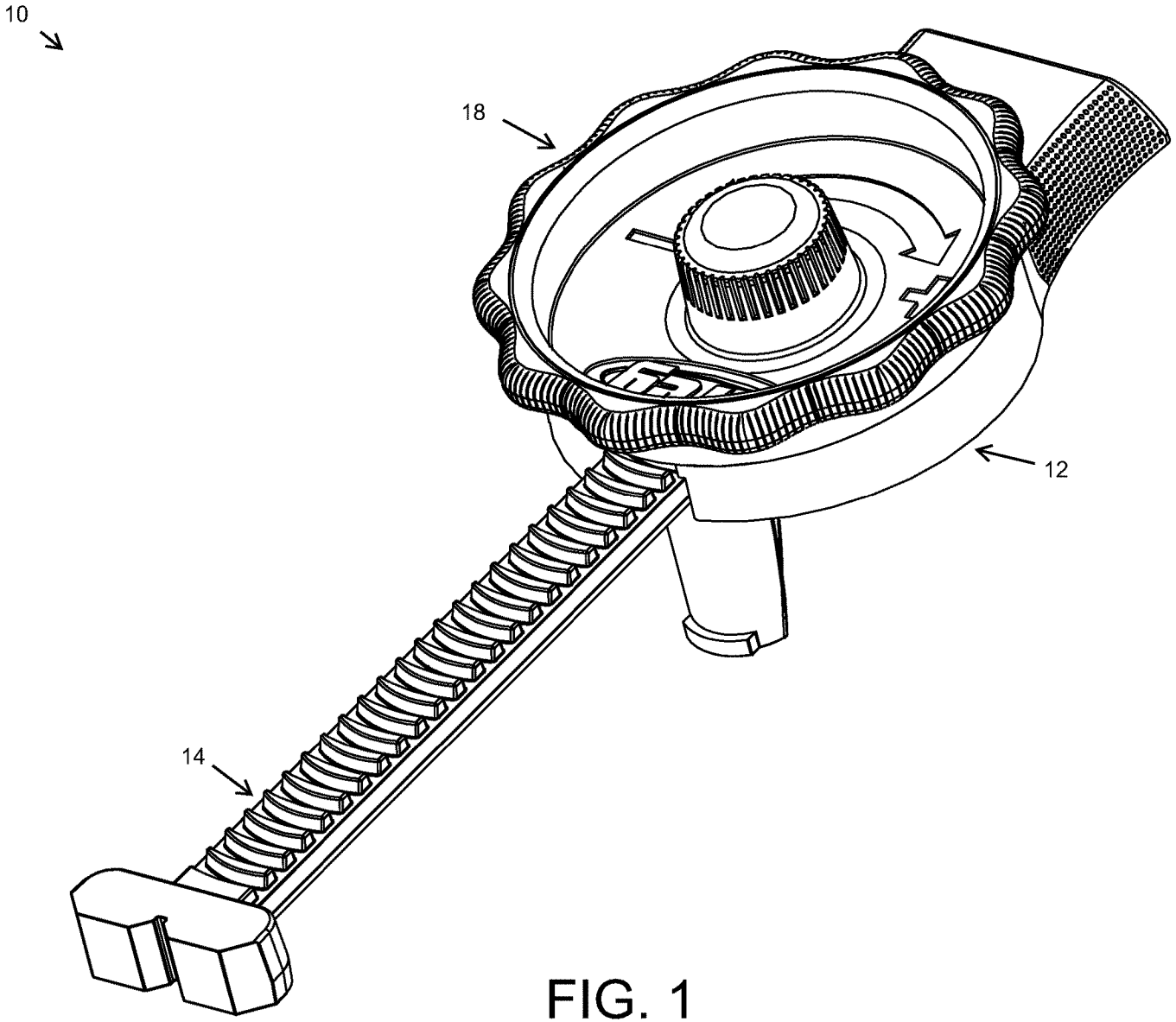
FIG. 1 is a perspective view of an inline clamp system, the view showing the base, the shoe, the scroll wheel and the cap.
Figure 2:
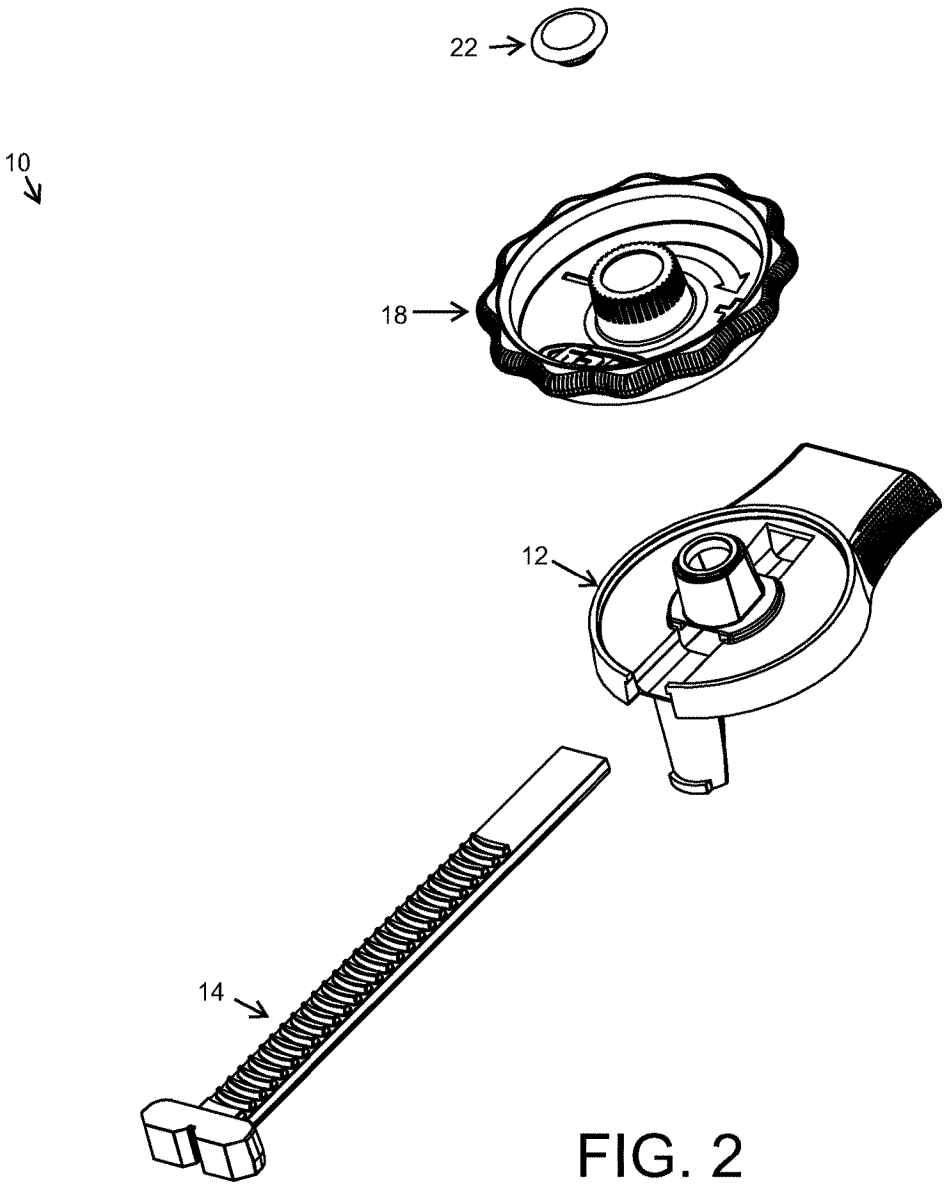
FIG. 2 is a is an exploded perspective view of an inline clamp system, the view showing the base, the shoe, the scroll wheel and the cap exploded from one another.
Figure 3:
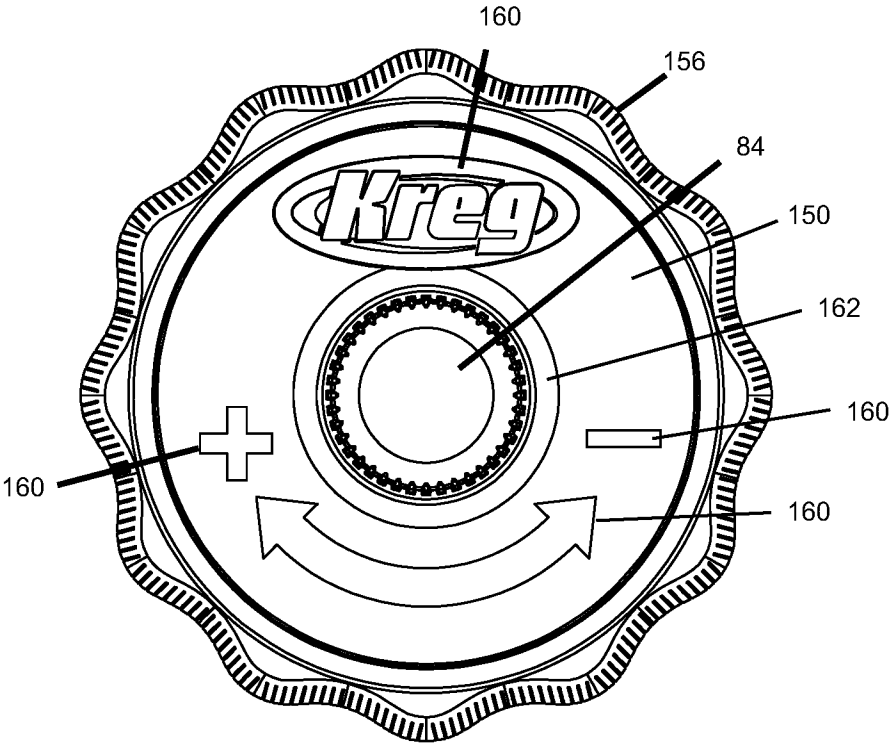
FIG. 3 is an elevation view of the upper surface of a scroll wheel for use with an inline clamp system, the view showing the upper surface of the scroll wheel, a grip feature connected to an exterior wall, a tower extending upward from the upper surface with an opening positioned at its middle, and indicia positioned in the upper surface.

The figures show one or more embodiments of an inline clamp system. In one arrangement, the inline clamp system has a base, a shoe having a plurality of teeth and a scroll wheel having a helical feature on a cone shaped surface. The helical feature of the scroll wheel meshes with the teeth of the shoe such that rotation of the scroll wheel in a first rotational direction causes linear movement of the shoe in a first linear direction and rotation of the scroll wheel in a second rotational direction causes linear movement of the shoe in a second linear direction, the first rotational direction being opposite the second rotational direction and the first linear direction being opposite the second linear direction. In the arrangement shown, as one example, the scroll wheel rotates around an axis of rotation and the shoe moves in a linear plane, the axis of rotation of the scroll wheel is positioned at a slight angle to the linear plane of the shoe such that the helical feature of the scroll wheel engages and/or meshes with the teeth of the shoe on a first side of the axis of rotation whereas the helical feature of the scroll wheel is free from engagement with the teeth of the shoe on a second side of the axis of rotation.

DETAILED DESCRIPTION OF THE DISCLOSURE

In the following detailed description, reference is made to the accompanying drawings which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that mechanical, procedural, and other changes may be made without departing from the spirit and scope of the disclosure (s). The following detailed description is, therefore, not to be taken in a limiting sense, and the scope of the disclosure(s) is defined only by the appended claims, along with the full scope of equivalents to which such claims are entitled.

As used herein, the terminology such as vertical, horizontal, top, bottom, front, back, end, sides, left, right, and the like are referenced according to the views, pieces, parts, components and figures presented. It should be understood, however, that the terms are used only for purposes of description, and are not intended to be used as limitations. Accordingly, orientation of an object or a combination of objects may change without departing from the scope of the disclosure.

System:

With reference to the figures, an inline clamp system 10 (or clamp system 10 or simply system 10) is presented. The inline clamp system 10 is formed of any suitable size, shape and design and is configured to clamp workpieces on a support surface. In the arrangement shown, as one example, the inline clamp system 10 includes a base 12, a shoe 14 having a plurality of teeth 16, a scroll wheel 18 having a helical feature 20 and a cap 22 among other parts, components, pieces and features. In the arrangement shown, the helical feature 20 of scroll wheel 18 meshes with the plurality of teeth 16 of shoe 14 such that rotation of scroll wheel 18 causes lateral or linear movement of shoe 14. In the arrangement shown, inline clamp system 10 includes an upper side 24, a lower side 26, a forward side 28, a rearward side 30 and opposing lateral sides 32.

Base:

With reference to FIGS. 8-13, a base 12 is presented. Base 12 is formed of any suitable size, shape and design and is configured to hold shoe 14, scroll wheel 18 and cap 22 so as to facilitate operation of inline clamp system 10. In the arrangement shown, as one example, base 12 holds shoe 14 such that shoe 14 slides within base 12 while base 12 holds scroll wheel 18 such that scroll wheel 18 rotates upon base 12 and cap 22 holds the scroll wheel 18 on base 12 as is further described herein.

In the arrangement shown, as one example, base 12 includes a main body 34 that when viewed from above or below has a generally circular shape with an exterior wall 36 that extends between an upper surface 38 and a lower surface 40. However any other non-round shape is hereby contemplated for use.

In the arrangement shown, as one example, when viewed from the side, lower surface 40 establishes a generally flat surface or plane. This flat surface or plane formed by lower surface 40 is configured to sit in a flat and flush manner on a support surface such as a table top, bench top or the like. As can be seen when viewed from below, in the arrangement shown, as one example, the lower surface 40 includes a plurality of structural members 42 that provide added strength and rigidity to base 12, the bottom edge of which helps to establish the plane of lower surface 40.

In the arrangement shown, as one example, the rearward side 30 of base 12 includes a tail section 44 that connects to the rearward side 30 of main body 34 and extends rearward a distance from main body 34. The rearward extension of tail section 44 provides a convenient extended surface area for a user to grasp and manipulate the direction that inline clamp system 10 points. In the arrangement shown, tail section 44 has exterior surfaces 46 that connect at their forward end to the main body 34 and connect at their rearward end to a generally flat rearward wall 48. In the arrangement shown, the exterior surfaces 46 of tail section 44 curve or arc inward as they extend rearward. In the arrangement shown, all or a portion of the exterior surface 46 of tail section 44 is textured so as to provide increased friction so as to improve a user's grip on the tail section 44.

In the arrangement shown, as one example, when viewed from the side, upper surface 38 establishes a generally flat surface or plane, or alternatively a conical surface. When viewed from above, the flat plane or conical surface of upper surface 38 of base 12 is formed by a narrow ridge or ring that is formed in a generally cylindrical shape. A recessed area 50 is positioned inward of the ridge of upper surface 38. The plane or conical surface formed by upper surface 38 of base 12 is configured to receive the exterior edge of the lower surface of scroll wheel 18 and the recessed area 50 positioned just inward of the upper surface 38 is configured to receive and to provide clearance for the helical feature 20 of scroll wheel 18 as the scroll wheel 18 rotates.

A tower 52 is positioned approximately at the center of the recessed area 50 and extends upward from the upper surface of recessed area 50. Tower 52 is formed of any suitable size, shape and design and is configured to facilitate connection of scroll wheel 18 to base 12 while also facilitating rotation of scroll wheel 18 with respect to base 12. In the arrangement shown, tower 52 is generally cylindrical in shape with a generally flat and smooth exterior surface that angles inward slightly as it extends upward. In this way, tower 52 is formed of a portion of a cone. The lower end of tower 52 connects to a platform 54.

In the arrangement shown, platform 54 extends upward from the upper surface of recessed area 50 a distance and terminates in a generally planar upper surface. The upper surface of platform 54 is configured to engage the lower surface of scroll wheel 18. As scroll wheel 18 rotates, the lower surface of scroll wheel 18 slides over the upper surface of platform 54. In this way, the upper surface of platform 54 provides a stop surface for the interior portion of scroll wheel 18. In the arrangement shown, the exterior periphery of platform 54 is generally circular in shape and terminates in generally flat forward and rearward walls that extend in approximate parallel spaced relation to one another. The termination of the circular shape of platform 54 at the flat forward and rearward walls provides access to the teeth 16 of shoe 14, as is further described herein. The recessed area 50 between the exterior edge or periphery of platform 54 and the ridge formed by upper surface 38 provides clearance for the helical feature 20 of scroll wheel 18 to rotate therein.

As such, when scroll wheel 18 rotates around tower 52 the exterior edge of the lower surface of scroll wheel 18 is in flat and flush sliding engagement with the ridge formed by the upper surface 38 of base 12 while the interior edge of the lower surface of scroll wheel 18 is in flat and flush sliding engagement with the upper surface of platform 54 while the helical feature 20 rotates within the recessed area 50 between upper surface 38 and platform 54. This arrangement ensures the accurate relative positioning of the helical feature 20 of scroll wheel 18 as the interior edge of the lower surface of scroll wheel 18 is supported by platform 54 and the exterior edge of the lower surface of scroll wheel 18 is supported by upper surface 38. In an alternative arrangement, only one of the exterior edge or the interior portion of scroll wheel 18 engages and/or is in flush and sliding engagement with base 12.

While the exterior surface of tower 52 is generally cylindrical in shape, the exterior surface of tower 52 includes a pair of generally flat walls 56 that are positioned on opposite sides of tower 52. In the arrangement shown, the walls 56 are positioned on the lateral sides 32 of base 12. However in other arrangements, the flat walls 56 are not present and the tower 52 takes on a cylindrical shape or cone shape all the way around the surface of tower 52. Any other shape is hereby contemplated for use.

The upper end of tower 52 includes an upper step 58 and an opening 60 that connects to the hollow interior 64 of tower 52. Upper step 58 of tower 52 serves as a stop surface for the reception of cap 22 and helps to align the cap 22 with tower 52. In one arrangement, when viewed from the side, upper step 58 is formed of an approximately right angled notch in the upper surface of tower 52 and when viewed from above forms a circular shaped ridge or ring that extends around the upper surface of tower 52, however any other shape is hereby contemplated for use, as is the absence of step 58. Opening 60 facilitates the connection of cap 22 to base 12 and allows the insertion of a lower portion of cap 22 into the tower 52 thereby facilitating the connection of the two components as is further described herein. In the arrangement shown, as one example, opening 60 is a generally circular opening or hole when viewed from above that connects to the hollow interior 64 of tower 52, however any other shape is hereby contemplated for use. In the arrangement shown, the lower end of opening 60 terminates in a lower step 62 that connects to the larger diameter of hollow interior of tower 52. Lower step 62 provides a surface that is approximately opposite the upper surface of tower 52 and extends in approximately parallel spaced relation to the upper surface of tower 52. The lower surface of lower step 62 extends in approximate perpendicular relation to the interior surface of opening 60. The approximately perpendicular lower surface of lower step 62 provides a surface or feature that facilitates connection of cap 22 to the upper end of tower 52 as is further described herein.

Base 12 includes a slot 66. In the arrangement shown, slot 66 extends through base 12 from the forward side 28 to the rearward side 30 and is approximately centrally positioned therein as it extends from the forward side 28 to the rearward side 30 of base 12. Slot 64 is sized and shaped and configured to receive a portion of shoe 14 therein within close and tight tolerances while allowing sliding movement of shoe 14 within slot 66.

In the arrangement shown, as one example, when viewed from the forward side 28 or rearward side 30 of base 12 slot 66 is generally rectangular in shape and includes a generally flat bottom surface 68 that extends in approximate parallel spaced relation to a generally flat upper surface 70. Slot 66 also includes opposing sidewalls 72 that extend in approximate parallel spaced relation to one another. Sidewalls 72 extend in approximate perpendicular relation to upper surface 70 and bottom surface 68. In the arrangement shown, as one example, the lower corners 74 between sidewalls 72 and bottom surface 68 are smooth or rounded, so as to facilitate smooth gliding of the shoe 14 within slot 66. However, sharp and/or squared corners are also contemplated for use. Also in the arrangement shown, as one example, an inward step 76 is positioned at the upper corner between sidewalls 72 and upper surface 70. The presence of step 76 provides clearance for the teeth 16 of shoe 14.

Figure 13:
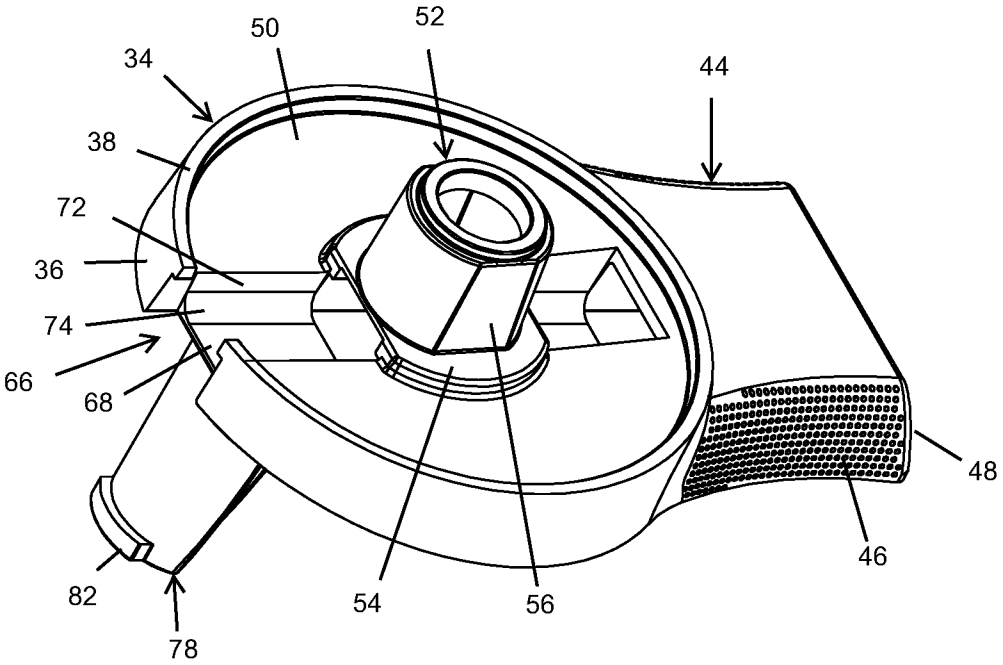
FIG. 13 is a perspective view of a base for use with an inline clamp system, the view showing the main body having a generally flat bottom surface and a generally flat upper surface wherein the generally flat upper surface is positioned at a slight angle to the generally flat bottom surface such that the forward end of the generally flat upper surface angles toward the generally flat bottom surface; the view showing the tail section connected to the main body of the base and trailing rearward therefrom; the view showing a post extending downward from the lower surface of the base; the view showing a tower extending upward from approximately the center of a recessed area with the lower end of the tower connected to a platform that bridges a slot; the view showing detailed features of the slot, including how the upper surface of the slot is open in front of and behind the tower.
Figure 14:
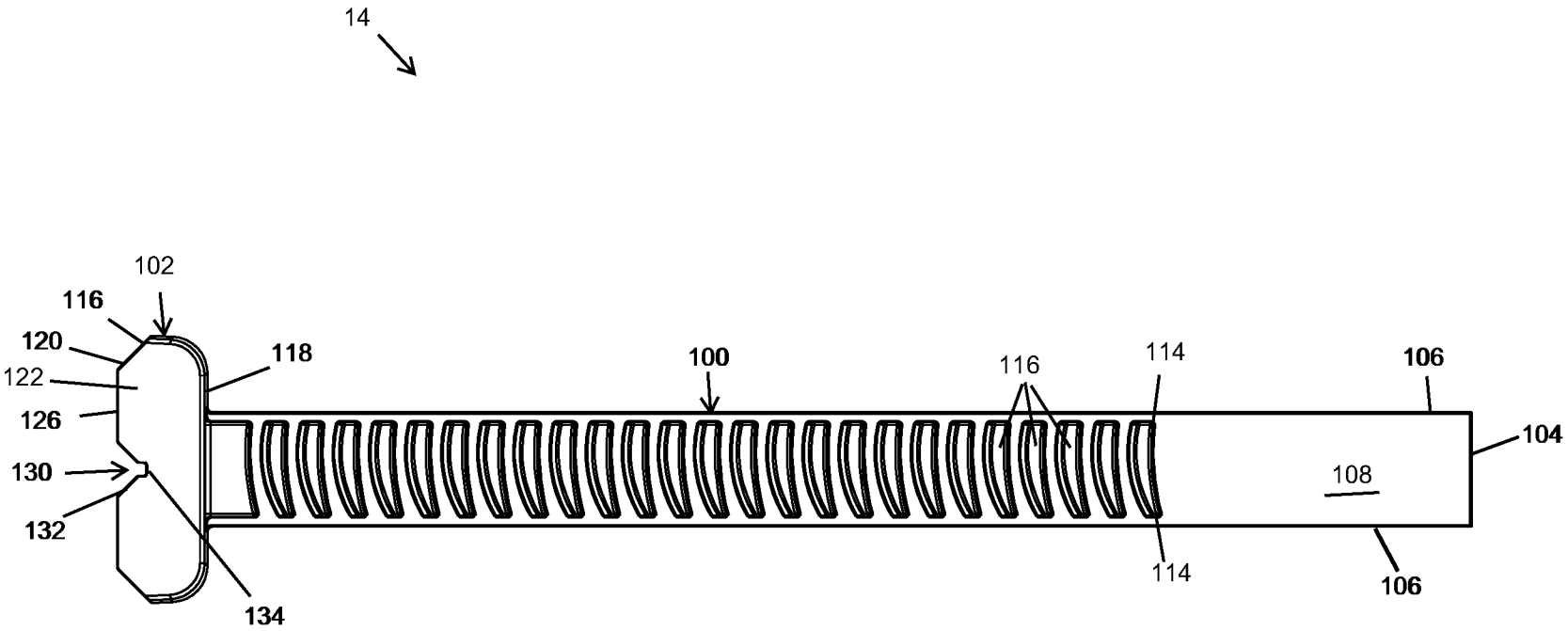
FIG. 14 is an elevation view of the upper surface of a shoe for use with an inline clamp system, the view showing an elongated pushrod having a generally rectangular shape; the view showing a plurality of teeth in the upper surface of the pushrod, the teeth having an arcuate curve and with a wider side and a narrower side; the view showing a plunger connected to the forward end of the pushrod the plunger having a flat forward wall for pushing a flat surface, angled outward walls for pushing against an inside corner, and a center recess for pushing against an outside corner.
Figure 15:
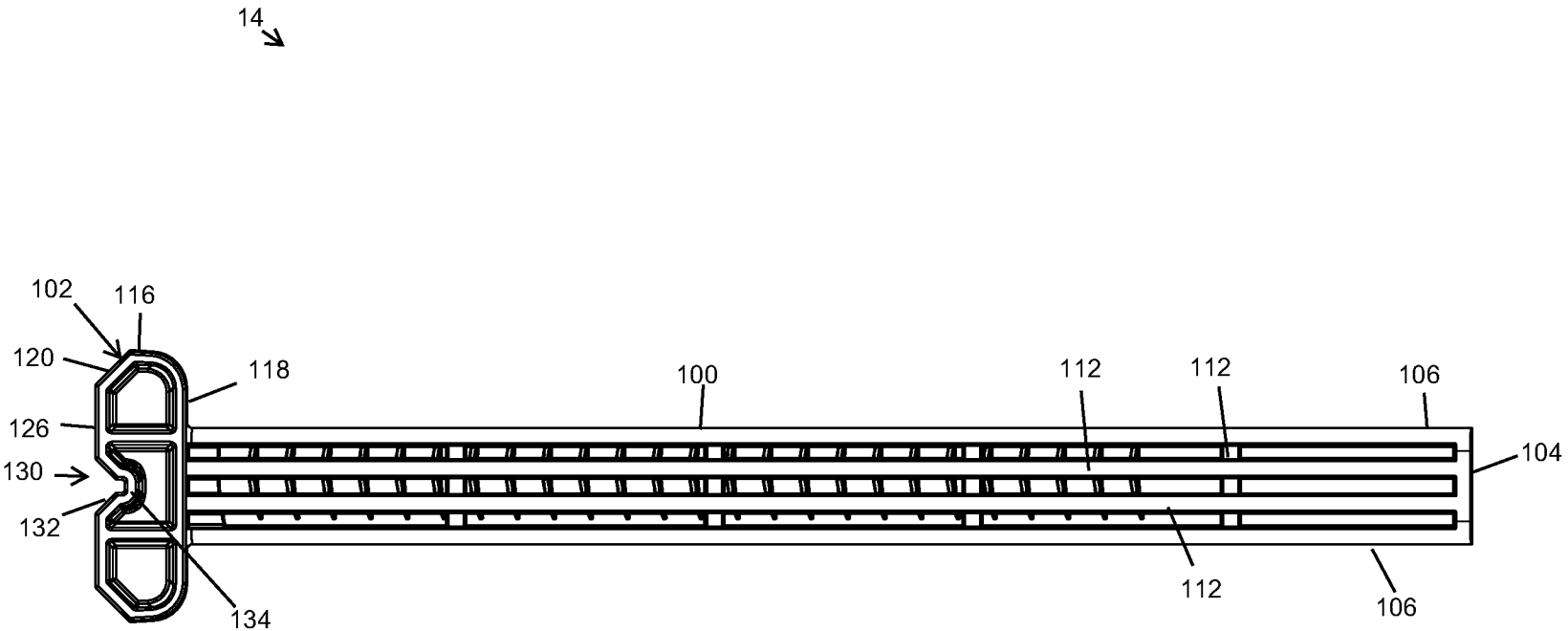
FIG. 15 is an elevation view of the lower surface of a shoe for use with an inline clamp system, the view showing an elongated pushrod having a generally rectangular shape; the view showing a plurality structural features in the lower surface of the pushrod; the view showing a plunger connected to the forward end of the pushrod the plunger having a flat forward wall for pushing a flat surface, angled outward walls for pushing against an inside corner, and a center recess for pushing against an outside corner.
Figure 16:
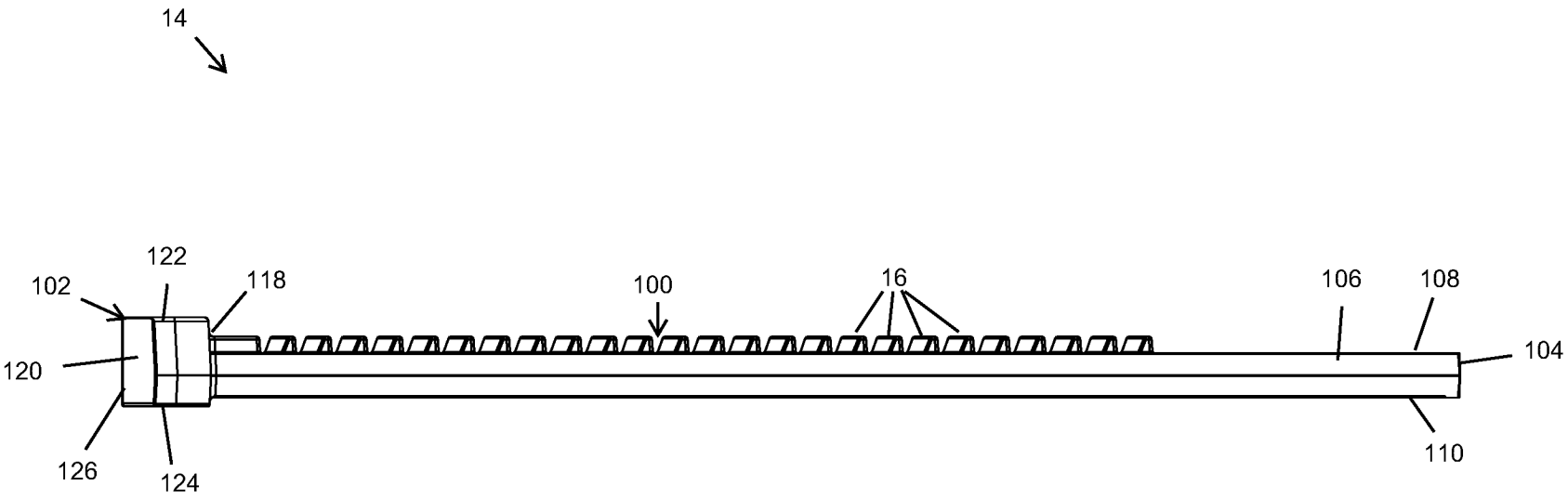
FIG. 16 is a side elevation view of a shoe for use with an inline clamp system, the view showing an elongated pushrod having a generally rectangular shape; the view showing a plurality of teeth in the upper surface of the pushrod, the teeth having an arcuate curve; the view showing a plunger connected to the forward end of the pushrod the plunger having a flat forward wall for pushing a flat surface, angled outward walls for pushing against an inward corner.

As one example, as is seen in the perspective view of FIG. 13, while slot extends through the entire forward-to-back length of base 12, the bottom surface 68 is only present at portions of the length of slot 66. Similarly, while slot extends through the entire forward-to-back length of base 12, the upper surface 70 is only present at portions of the length of slot 66. The upper surface 70 is present below tower 52 as well as in a portion of slot 66 that extends through tail section 44. The bottom surface 68 is present forward of tower 52 and terminates at or before the forward end of base 12. This portion of bottom surface 68 provides support for post 78 that extends downward therefrom. The bottom surface 68 is also present rearward of tower 52 and terminates at or prior to the intersection of tail section 44. In an alternative arrangement, bottom surface 68 extends the entire length or most of the length or any other portion of the length of base 12.

The absence of upper surface 70 of slot 66 at portions of slot 66 provides access to the teeth 16 of shoe 14. More specifically, the absence of upper surface 70 in front of tower 52 and rearward of tower 52 provides access to the teeth 16 of shoe 14 as shoe 14 slides through slot 66.

In the arrangement shown, as one example, a post 78 extends outward and/or downward from the lower surface 40 of base 12. Post 78 is formed of any suitable size, shape and design and is configured to connect base 12 to a support surface such as a benchtop, table top or any other work surface. In the arrangement shown, as one example, post 78 is a generally cylindrical member that connects at its upper edge to the lower surface 40 of base 12 and extends downward a distance before terminating at a generally flat lower surface 80 that extends in approximately parallel spaced relation to the plane formed by the lower surface 40 of base 12. In the arrangement shown, as one example, when post 78 is generally cylindrical in shape post 78 facilitates connection to an opening or hole in a support surface, which may be known as a "bench dog" grid of holes. In the arrangement shown, a feature 82 is positioned at the lower end and forward side of post 78 which extends forward a short distance therefrom. This feature 82 helps to hold the clamping system 10 in an opening in a support surface, such as a bench dog hole and prevents unintentional pull out.

In the arrangement shown, post 78 is placed forward a distance from the center of main body 34 of base 12. More specifically, in the arrangement shown, post 78 connects to the bottom surface 68 of slot 66 which is positioned forward of tower 52 and/or forward of the axis of rotation of scroll wheel 18. Positioning post 78 forward of the center of main body 34 of base 12 or off-center to the base 12 helps to have the clamp system 10 trail rearward as the shoe 14 pushes against a workpiece. That is, by placing post 78 forward of the center of main body 34 of base 12 this provides increased stability to clamp system 10 as pressure is applied by shoe 14 against a workpiece. Alternatively, it is contemplated that post 78 may be placed at any position of base 12.

Post 78 may be formed of a cylindrical member that extends in a continuous or generally manner for the entire length of post 78 that is sized and shaped to fit within an opening in a support surface, such as a bench dog hole within close and tight tolerances. In an alternative arrangement, as is shown, a portion of the lower rearward side of post 78 is removed. This facilitates easier insertion into and removal from an opening in a support surface, such as a bench dog hole while not reducing strength or stability.

In an alternative arrangement, post 78 may be replaced with any other mechanism, device or feature that facilitates connection of base 12 to a support surface. One example includes a threaded shaft that facilitates connection to a support surface by extending the threaded shaft through an opening in the support surface and threading a nut on the opposite side thereby tightening the clamp system 10 to the support surface. Another example includes the use of an expandable plug that is inserted within an opening in a support surface and is then expanded thereby locking the clamp system 10 to the support surface.

In yet another alternative arrangement, post 78 is not present and instead base 12 is connected to the support surface by any other manner, method or means. In one arrangement, one or more screws or bolts are passed through base 12 and into the support surface thereby connecting the two components together. In one arrangement, to facilitate this connection, base 12 includes one or more openings that are sized, shaped and configured to receive a screw or bolt therein. In another arrangement, base 12 includes one or more feet that extend outward from the exterior wall 36 or exterior surface 46 that include openings that are sized, shaped and configured to receive a screw or bolt therein. Any other manner, method or means of connecting base 12 to the support surface is hereby contemplated for use.

In another arrangement, main body 34 includes two or more posts 78 that extend downward from main body 34 so as to connect to two holes in a work surface, such as two adjacent holes of a bench dog grid of holes. This arrangement provides the benefit of providing precise alignment to the system 10 by attaching to two bench dog holes which provides strength as well as alignment. Similarly, main body 34 may include two or more scroll wheels 18 and a corresponding number of shoes 14. This arrangement with multiple shoes 14 controlled by multiple scroll wheels 18 can provide multiple points of clamping pressure, increased strength and stability, a spread out clamping force and a greater number of applications and capabilities.

Figure 12:
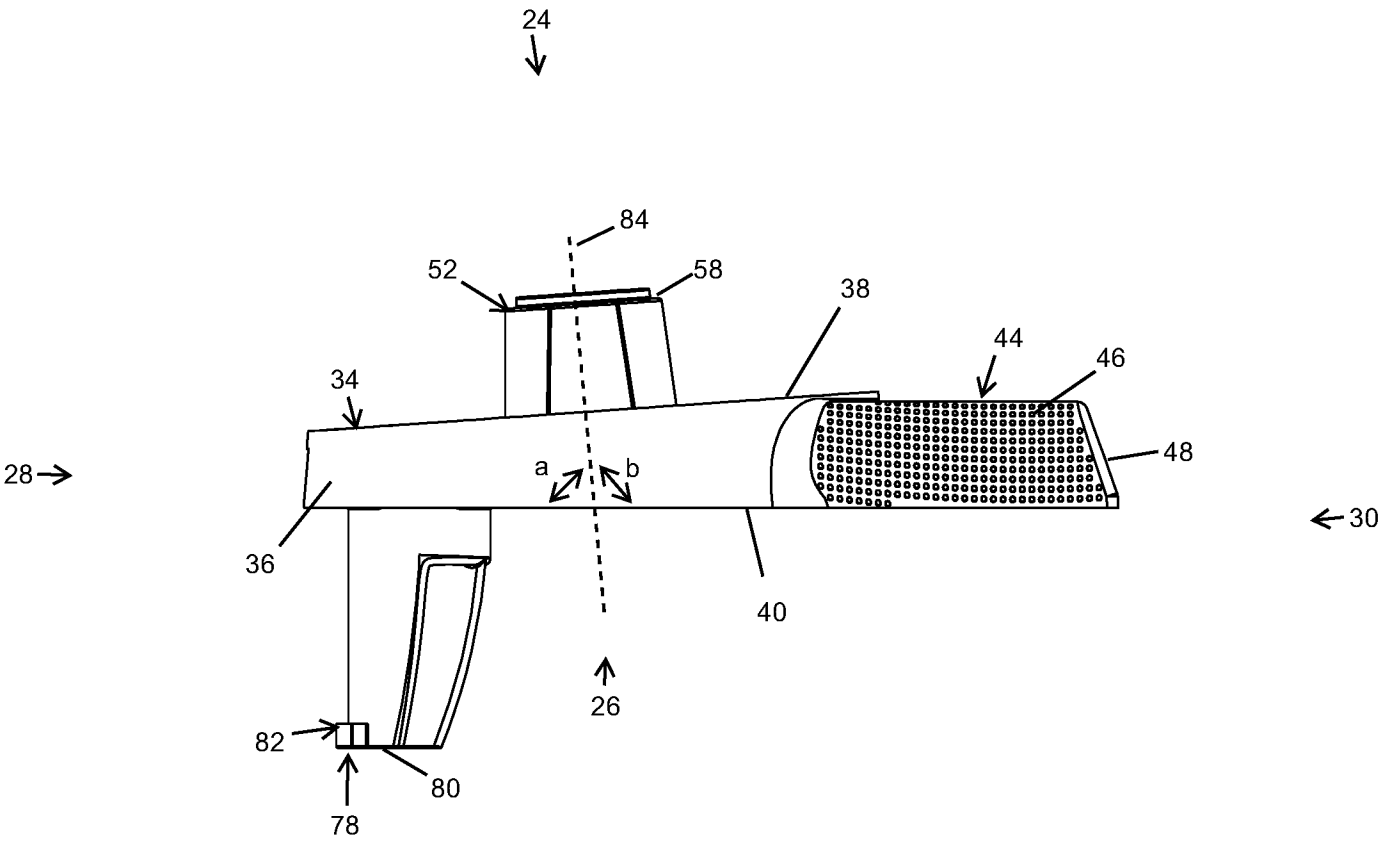
FIG. 12 is a side elevation view of a base for use with an inline clamp system, the view showing the main body having a generally flat bottom surface and a generally flat upper surface wherein the generally flat upper surface is positioned at a slight angle to the generally flat bottom surface such that the forward end of the generally flat upper surface angles toward the generally flat bottom surface; the view showing the tail section connected to the main body of the base and trailing rearward therefrom; the view showing a post extending downward from the lower surface of the base.
Figure 12B:
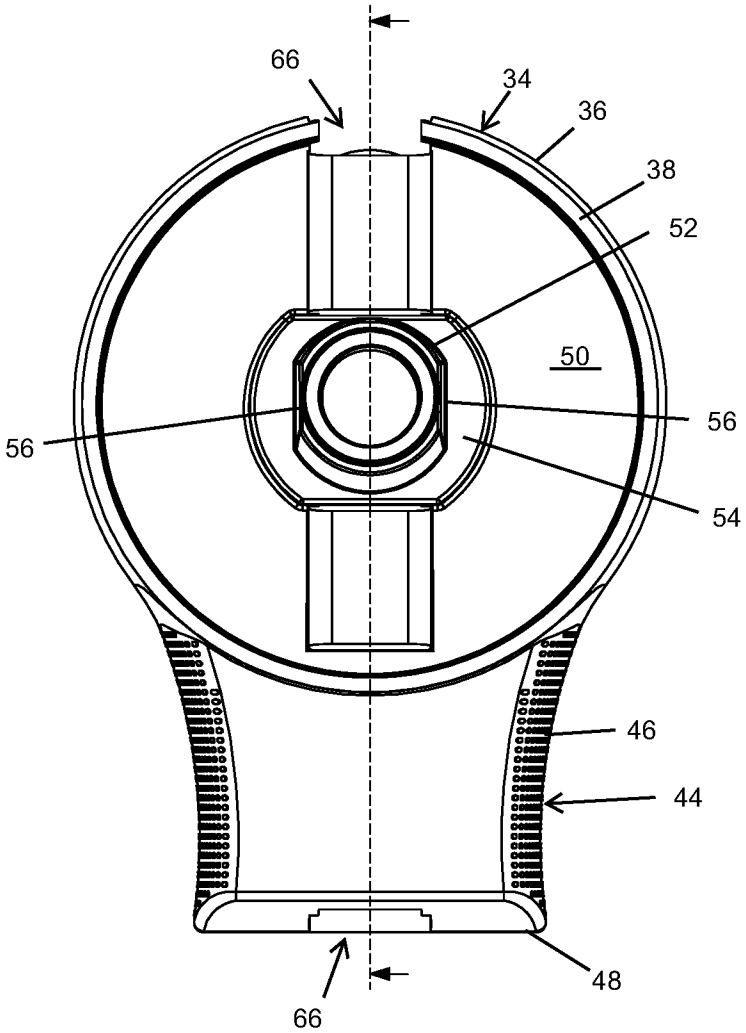
FIG. 12B is an elevation view of the upper surface of a base for use with an inline clamp system, the view showing a dashed line that represents the approximate placement of the section view of FIG. 12A.
Figure 12A:
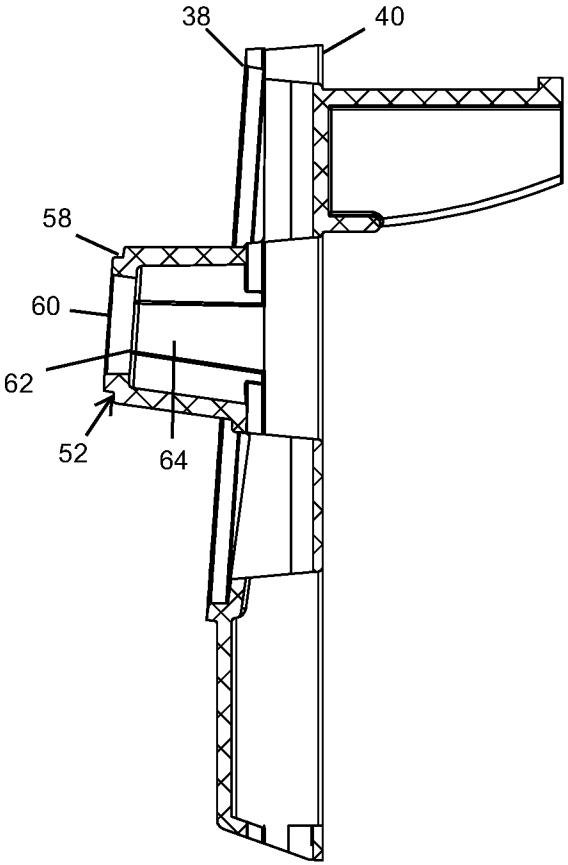
FIG. 12A is a side elevation view of a base for use with an inline clamp system, the view showing a section view through the approximate forward-to-back center of the base, the view showing the main body having a generally flat bottom surface and a generally flat upper surface wherein the generally flat upper surface is positioned at a slight angle to the generally flat bottom surface such that the forward end of the generally flat upper surface angles toward the generally flat bottom surface; the view showing the tail section connected to the main body of the base and trailing rearward therefrom; the view showing a post extending downward from the lower surface of the base; the view showing a tower extending upward from approximately the center of a recessed area.

As can be seen from the side view of FIG. 12, the upper surface 38 is positioned at a slight angle to the lower surface 40. That is, the upper surface 38 is closer to the lower surface 40 at the forward side 28 of main body 34 than it is at the rearward side 30 of main body 34. That is, the conical surface or planar surface formed by the upper surface 38 angles toward the lower surface 40 forward of the center of main body 34 and the plane or conical surface formed by the upper surface 38 angles away from the lower surface 40 rearward of the center of main body 34. This angular alignment of the upper surface 38 and the lower surface 40 facilitates meshing engagement of the teeth 16 of shoe 14 with the helical feature 20 of the scroll wheel 18 forward of the tower 52 while facilitating clearance between the teeth 16 of shoe 14 and the helical feature 20 of the scroll wheel 18 rearward of the tower 52. It is this meshing on one side of the axis of rotation of scroll wheel 18 and clearance on the opposite side of scroll wheel 18 which is what facilitates the linear movement of the shoe 14 as the scroll wheel 18 is rotated.

Tower 52 establishes an axis of rotation 84 for scroll wheel 18 to rotate around. This axis of rotation 84 extends approximately perpendicularly through the plane or conical surface formed by upper surface 38 of base 12. As the axis of rotation 84 is positioned in perpendicular alignment to the plane or conical surface formed by the upper surface 38 of base 12, the axis of rotation 84 is positioned at a slight angle to the plane established by the lower surface 40 of base 12. When viewed from the side, the angle between the plane of the lower surface 40 and the forward side of the axis of rotation, shown as "a" in FIG. 12 is an acute angle, and the angle between the plane of the lower surface 40 and the rearward side of the axis of rotation, shown as "b" in FIG. 12 is an obtuse angle. In contrast, when viewed from the side, the angle between the plane or conical surface of the upper surface 38 and the forward side of the axis of rotation, is a ninety-degree angle, and the angle between the plane or conical surface of the upper surface 38 and the rearward side of the axis of rotation, is also a ninety-degree angle.

In one arrangement, as one example, base 12, shoe 14 and/or scroll wheel 18, are formed of a single solid and unitary piece which may be formed by molding, 3D printing, machining, casting, or by any other manufacturing process. In another arrangement, base 12, shoe 14 and/or scroll wheel 18 may be formed of multiple connected pieces that may be connected in a permanent manner, such as by welding, gluing, adhering or the like, or these multiple pieces may be connected together in a removable manner such as by screwing, bolting, snap fitting or the like so as to form a single functional piece out of multiple pieces or components.

Shoe:

Shoe 14 is formed of any suitable size, shape and design and is configured to extend out of and retract into base 12 by rotation of scroll wheel 18. In the arrangement shown, as one example, shoe 14 includes a pushrod 100 that is a generally elongated member. In the example shown, pushrod 100 has a generally rectangular shaped member that extends a length between a plunger 102 that is connected to the forward end of pushrod 100 and a rear wall 104 positioned at the rearward end of push rod 100. Pushrod 100 includes a pair of opposing sidewalls 106 that extend in approximate parallel spaced alignment to one another. Sidewalls 106 connect at their rearward end to rear wall 104. Sidewalls 106 connect at their forward end to the rearward side of plunger 102.

In the arrangement shown, as one example, viewed from the side, pushrod 100 has an upper wall 108 and a lower wall 110. Upper wall 108 and lower wall 110 each form a generally flat plane that extends in approximate parallel spaced relation to one another. Upper wall 108 and lower wall 110 connect at their rearward end to rear wall 104 and at their forward end to the rearward side of plunger 102. The planes formed by upper wall 108 and lower wall 110 extend in approximate perpendicular alignment to the plane formed by rear wall 104. Similarly, the planes formed by upper wall 108 and lower wall 110 extend in approximate perpendicular alignment to the plane formed by the rearward side of plunger 102. When viewed from below, the lower surface of pushrod 100 includes a plurality of structural features 112 that extend between sidewalls 106 and/or between plunger 102 and rear wall 104. These structural features 112 provide added strength and rigidity to shoe 14. The lower edge of these structural features 112 form a part of the plane formed by lower wall 110. Any other arrangement or configuration of structural features 112 is hereby contemplated for use. Alternatively, shoe 14 is formed of a solid piece thereby obviating the need for structural features 112. However, in one arrangement, structural features 112 provide strength and rigidity to shoe 14 while reducing the amount of material required to form shoe 14.

A plurality of teeth 16 extend upward from the upper wall 108 of pushrod 100. Or, alternatively, a plurality of teeth 16 are cut into the upper wall 108 of pushrod 100. Teeth 16 are formed of any suitable size, shape and design and are configured to mesh with the threads of helical feature 20 in the scroll wheel 18. When viewed from above, in one arrangement, the exterior edges 112 of teeth 16 are positioned inward a distance from the sidewalls 106 of pushrod 100, however in an alternative arrangement, teeth 16 extend across the entire width of pushrod 100. In the arrangement shown, as one example, when viewed from above, teeth 16 have an arcuate curved forward surface that is convex in shape and an arcuate curved rearward surface that is concave in shape. The forward and rearward curved surfaces of teeth 16 terminate at their outward edges at exterior edges 112. In the arrangement shown, as one example, one side of teeth 16 is thicker or wider whereas the opposite side of teeth 16 is thinner or narrower, however in an alternative arrangement, teeth 16 are approximately the same width across their side-to-side length. In one arrangement the extension side of teeth 16 is thicker or wider than the retraction side of teeth 16. This arrangement facilitates proper meshing with the helical feature of scroll wheel 18 while facilitating lateral movement of shoe 14. However, when teeth 16 are the same width across their side-to-side length, lateral movement is facilitated by the movement of helical feature 20 of scroll wheel 18 as it is rotated. In an alternative arrangement, teeth 16 are symmetric in shape from side-to-side.

Also, in the arrangement shown, also one example, teeth 16 extend generally vertically upward from the upper wall 108 of pushrod 110 before terminating in a generally flat surface that extends in approximate parallel spaced relation to the upper wall 108 of pushrod 110. In this arrangement, teeth 16 are generally consistent in thickness along their vertical height. In this arrangement, helical feature 20 extends generally vertically downward from the lower surface 152 of scroll wheel 18 before terminating in a generally flat surface that extends in approximate parallel spaced relation to the lower surface 152 of scroll wheel 18. Having corresponding, vertically extending, teeth 16 and helical feature 20 facilitates proper meshing of teeth 16 and helical feature 20 in a flat and square and flush and full manner providing a high level of strength and performance. Also, by having teeth 16 and helical feature 20 extend vertically, this does not cause a force pushing or pulling scroll wheel 18 toward or away from main body 12 and/or shoe 14 as the scroll wheel is tightened. In an alternative arrangement, teeth 16 extend upward at an angle and helical feature 20 extends downward at a corresponding angle to facilitate proper meshing. In one arrangement, teeth 16 are wider at their upper end and helical feature 20 is wider at its lower end thereby forming a dovetail-like meshing arrangement where scroll wheel 18 cannot vertically pull apart from shoe 14 when teeth 16 are meshed with helical feature 20. Any other configuration of teeth 16 is hereby contemplated for use.

Plunger 102 is formed of any suitable size, shape and design and serves to engage and apply pressure to a workpiece. In the arrangement shown, as one example, plunger 102 is larger in size than pushrod 100 so as to provide greater surface area for engagement with a workpiece. In the arrangement shown, as one example, plunger 102 includes a pair of opposing sidewalls 116 that extend in approximate parallel spaced alignment to one another. Sidewalls 116 connect at their rearward end to rear wall 118. Sidewalls 116 connect at their forward end to the rear edge of angled walls 120. Sidewalls 116 extend in approximate parallel spaced relation with the sidewalls 106 of pushrod 100.

When viewed from the side, plunger 102 has an upper wall 122 and a lower wall 124. Upper wall 122 and lower wall 124 form a generally flat plane that extends in approximate parallel spaced relation to one another. Upper wall 122 and lower wall 124 connect at their rearward end to rear wall 118 and at their forward end to forward wall 126. The planes formed by upper wall 122 and lower wall 124 extend in approximate perpendicular alignment to the plane formed by rear wall 118. Similarly, the planes formed by upper wall 122 and lower wall 124 extend in approximate perpendicular alignment to the plane formed by angled walls 120. Similarly, the planes formed by upper wall 122 and lower wall 124 extend in approximate perpendicular alignment to the plane formed by forward wall 126. The planes of the rear wall 118 and the forward wall 126 extend in approximate parallel spaced relation to one another. In addition, the plane formed by forward wall 126 extends in approximate perpendicular relationship to the length of pushrod 100 so as to facilitate perpendicular engagement with a workpiece when the pushrod 100 is extended. The plane formed by lower wall 124 is positioned in approximate planar alignment with the lower wall 110 pushrod 100 whereas the upper wall 122 of plunger 102 is positioned above the upper wall 108 a distance. This increased vertical height of plunger 102 provides increased surface area for forward wall 126 so as to distribute the clamping pressure over a greater area of the workpiece to provide increased alignment and to prevent marring or marking of the workpiece.

Figure 17A:
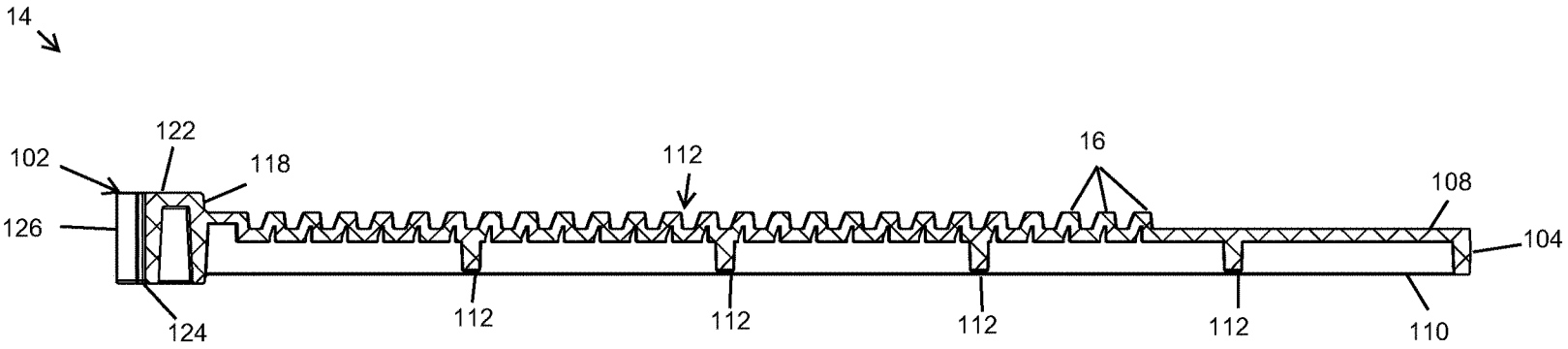
FIG. 17A is a side elevation view of a shoe for use with an inline clamp system, the view showing a section view through the approximate forward-to-back center of the shoe; the view showing an elongated pushrod having a generally rectangular shape; the view showing a plurality of teeth in the upper surface of the pushrod, the teeth having an arcuate curve; the view showing a plunger connected to the forward end of the pushrod the plunger having a flat forward wall for pushing a flat surface; the view showing a plurality structural features in the lower surface of the pushrod.
Figure 17B:
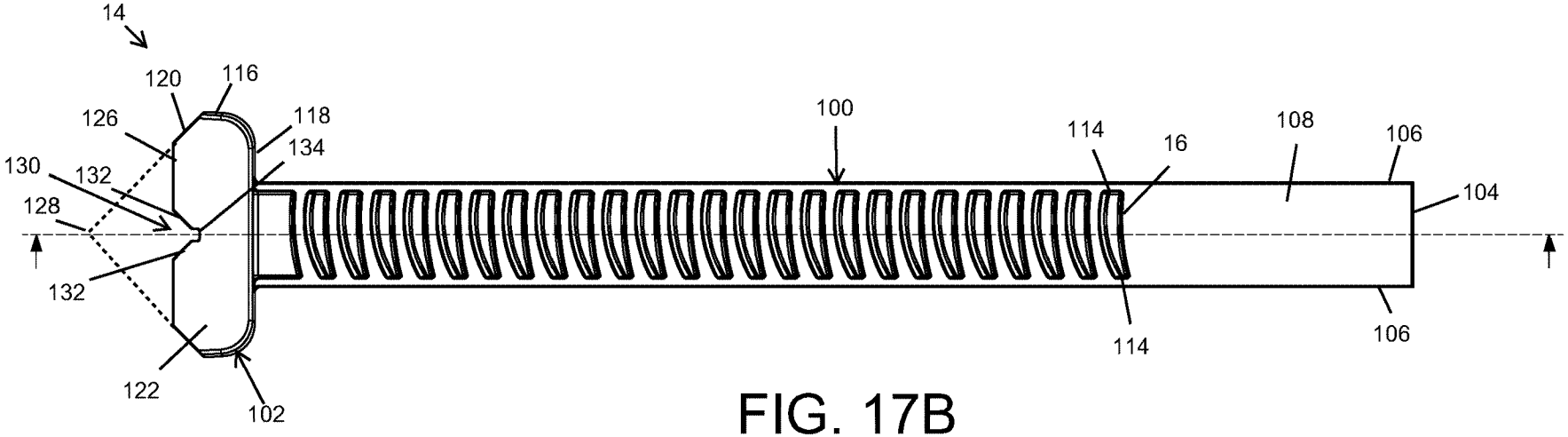
FIG. 17B is an elevation view of the upper surface of a shoe for use with an inline clamp system, the view showing a dashed line that represents the approximate placement of the section view of FIG. 17A.
Figure 18:
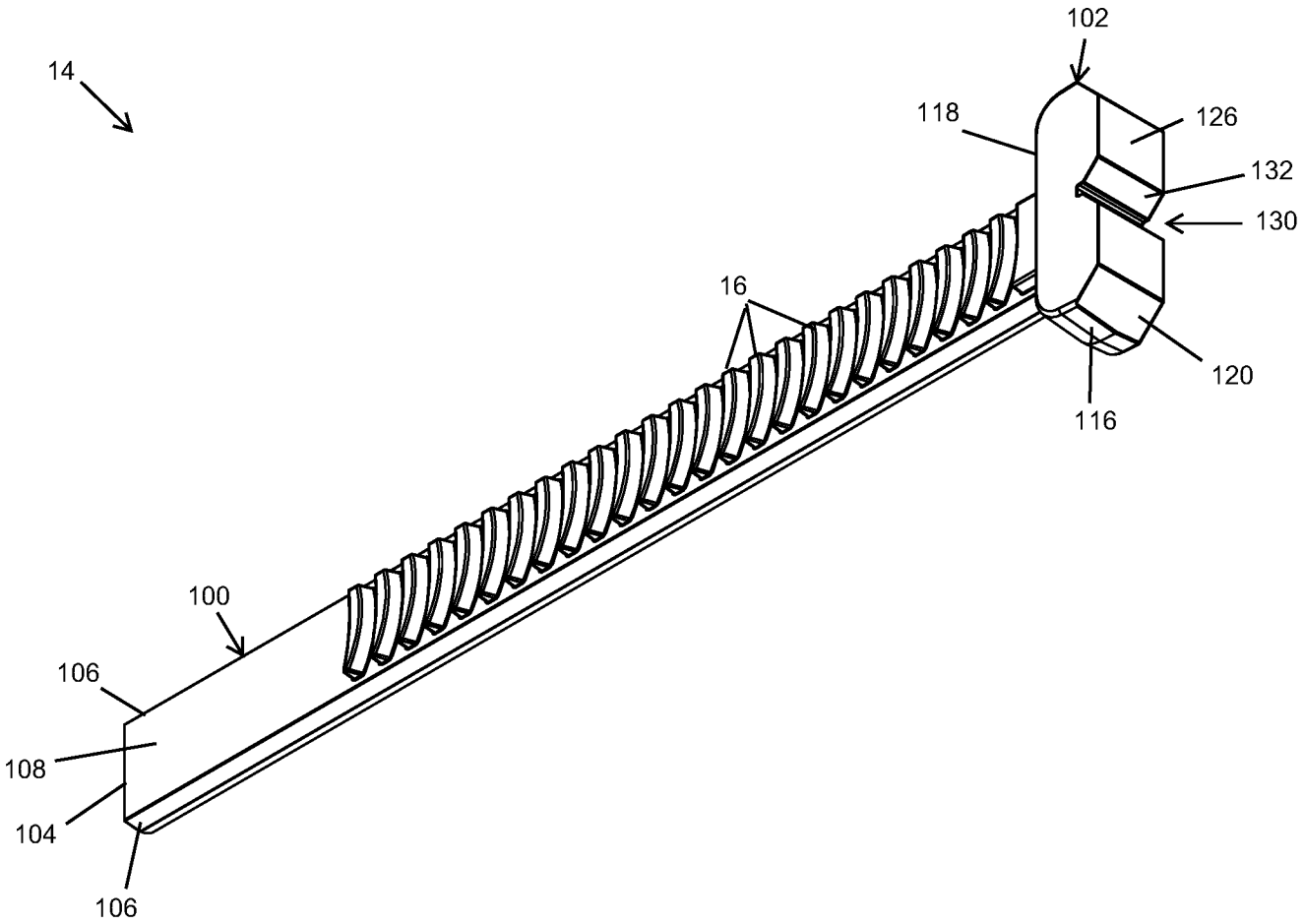
FIG. 18 is a perspective view of a shoe for use with an inline clamp system, the view showing an elongated pushrod having a generally rectangular shape; the view showing a plurality of teeth in the upper surface of the pushrod, the teeth having an arcuate curve and with a wider side and a narrower side; the view showing a plunger connected to the forward end of the pushrod the plunger having a flat forward wall for pushing a flat surface, angled outward walls for pushing against an inside corner, and a center recess for pushing against an outside corner.
Figure 19B:
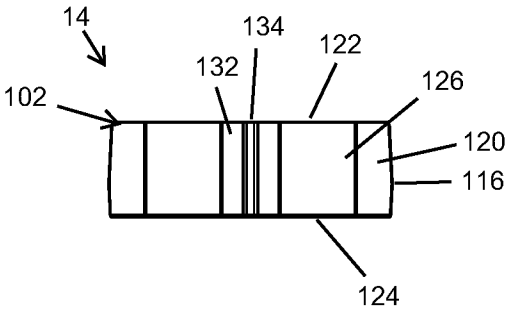
FIG. 19B is an elevation view of a forward side of a shoe for use with an inline clamp system, the view showing a plunger connected to the forward end of the pushrod; the view showing the plunger having a flat forward wall for pushing a flat surface, angled outward walls for pushing against an inside corner and a center recess for pushing against an outside corner.
Figure 19A:
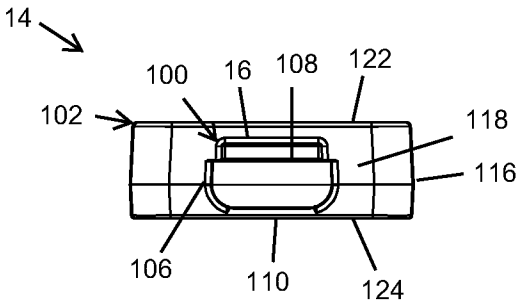
FIG. 19A is an elevation view of a rearward side of a shoe for use with an inline clamp system, the view showing the pushrod having a generally rectangular shape; the view showing a plurality of teeth in the upper surface of the pushrod; the view showing a plunger connected to the forward end of the pushrod.
Figure 20A:
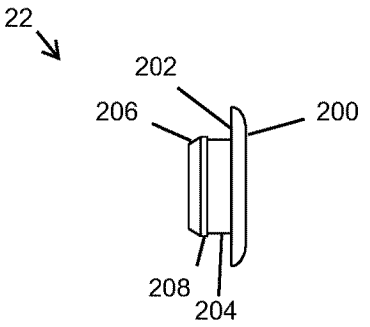
FIG. 20A is a side elevation view of a cap for use with an inline clamp system, the view showing the cap having an upper surface, a lower surface, a collar extending outward from the lower surface and an angled edge positioned at the end of the collar and a lip positioned at the upper edge of the angled edge.
Figure 20B:
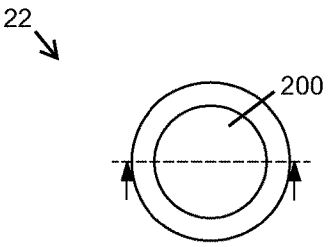
FIG. 20B is an elevation view of the upper surface of a cap for use with an inline clamp system, the view showing a dashed line that represents the approximate placement of the section view of FIG. 20E.
Figure 20C:
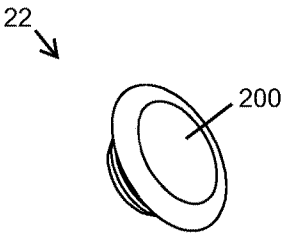
FIG. 20C is a perspective view of a cap for use with an inline clamp system, the view showing the cap having an upper surface, a lower surface, a collar extending outward from the lower surface and an angled edge positioned at the end of the collar and a lip positioned at the upper edge of the angled edge.
Figure 20D:
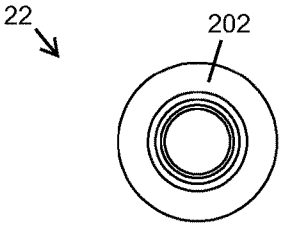
FIG. 20D is an elevation view of the bottom surface of a cap for use with an inline clamp system, the view showing the cap having a collar extending outward from the lower surface an angled edge positioned at the end of the collar.
Figure 20E:
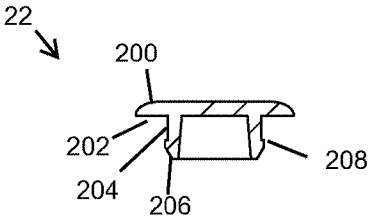
FIG. 20E is a side elevation view of a cap for use with an inline clamp system, the view showing a section view through the approximate center of the cap, the view showing the cap having an upper surface, a lower surface, a collar extending outward from the lower surface and an angled edge positioned at the end of the collar and a lip positioned at the upper edge of the angled edge.
Figure 20F:
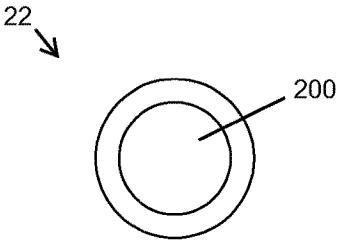
FIG. 20F is an elevation view of the upper surface of a cap for use with an inline clamp system.
Figure 21:
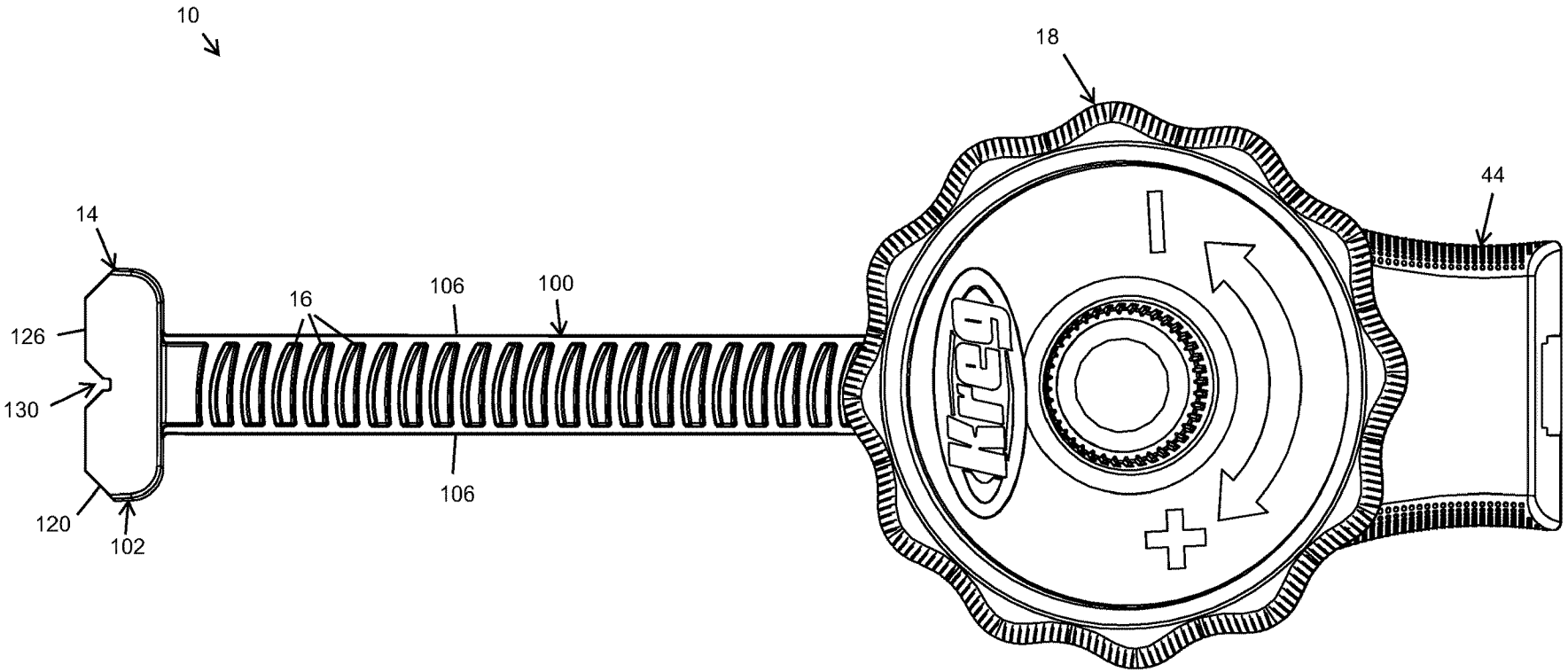
FIG. 21 is an elevation view the upper side of an inline clamp system, the view showing the base, the shoe, the scroll wheel and the cap in an assembled state; the view showing the shoe in a fully extended position.
Figure 22:
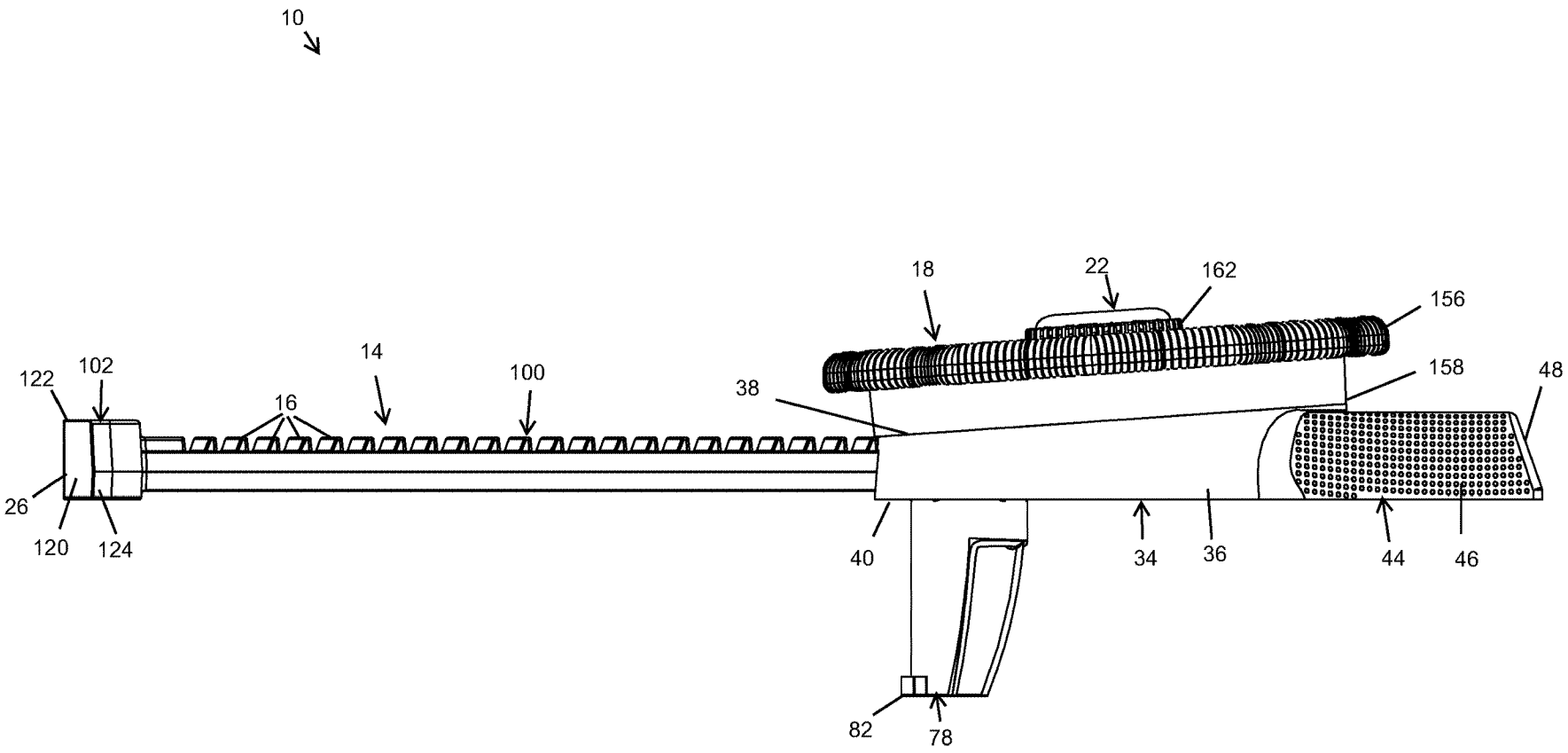
FIG. 22 is a side elevation view of an inline clamp system, the view showing the base, the shoe, the scroll wheel and the cap in an assembled state; the view showing the shoe in a fully extended position; the view showing the flat and flush engagement between the scroll wheel and the base at the seamline between the lower surface of the scroll wheel and the upper surface of the base.
Figure 23:
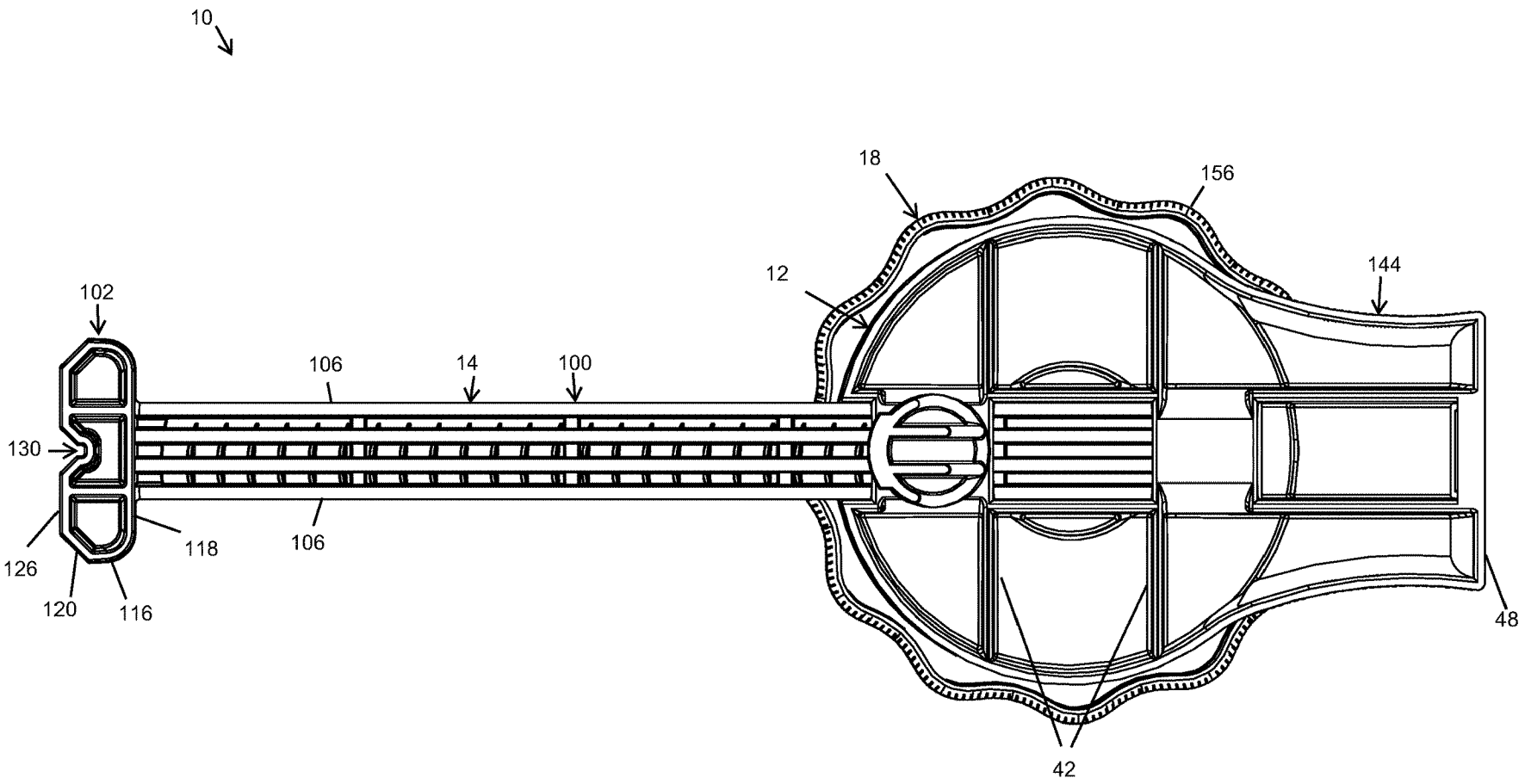
FIG. 23 is an elevation view the lower side of an inline clamp system, the view showing the base, the shoe and the scroll wheel in an assembled state; the view showing the shoe in a fully extended position.
Figure 24:
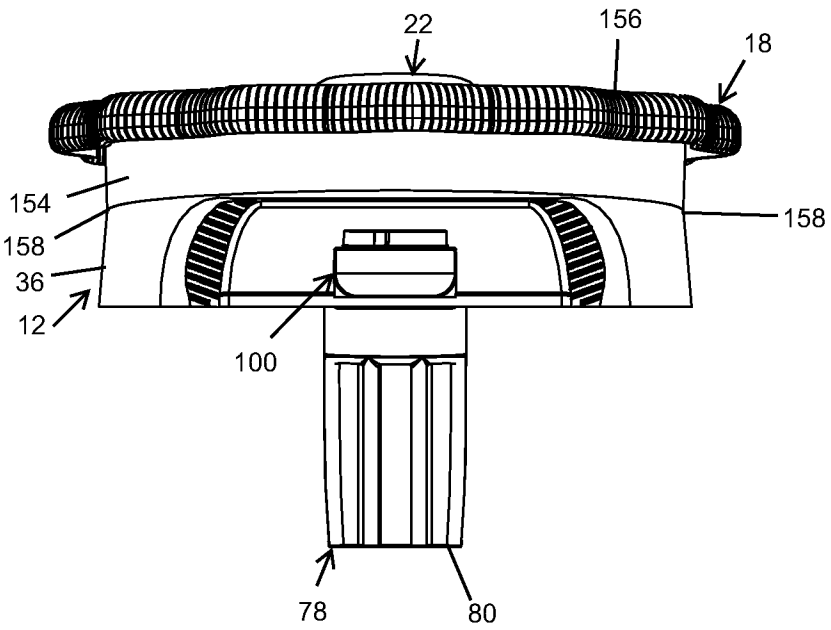
FIG. 24 is an elevation view the rear side of an inline clamp system, the view showing the base, the shoe, the scroll wheel and the cap in an assembled state.
Figure 25:
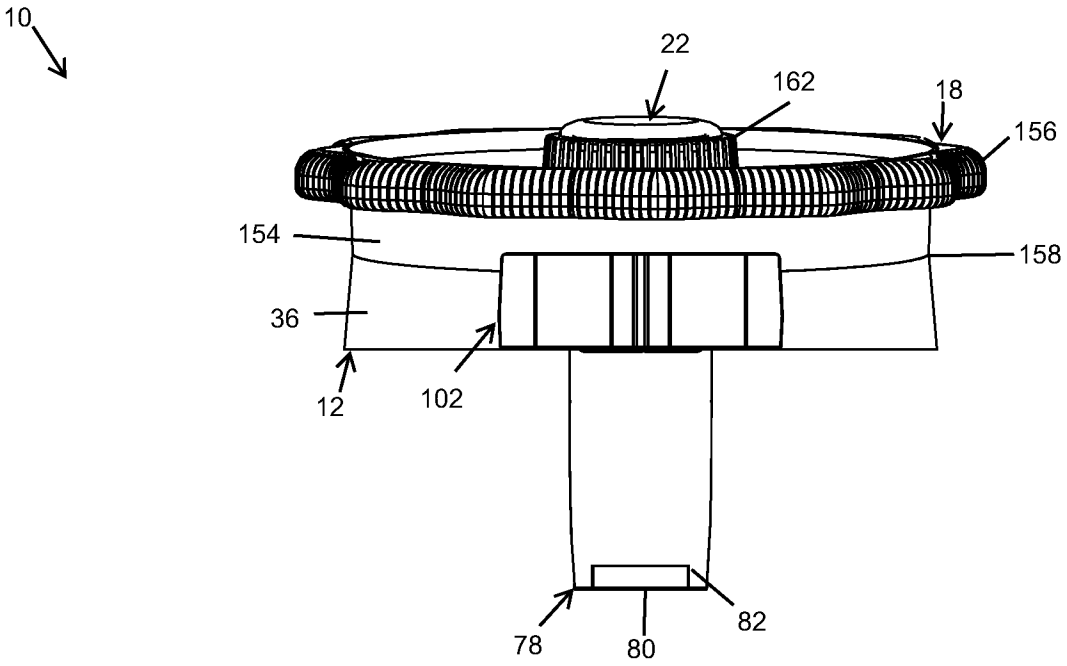
FIG. 25 is an elevation view the front side of an inline clamp system, the view showing the base, the shoe, the scroll wheel and the cap in an assembled state.
Figure 26A:
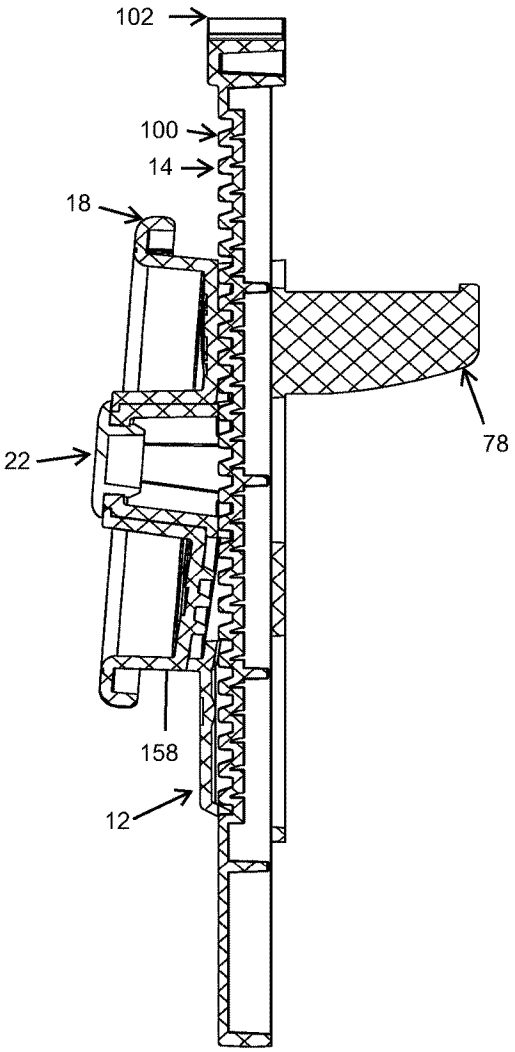
FIG. 26A is a side elevation view of an inline clamp system, the view showing the base, the shoe, the scroll wheel and the cap in an assembled state, the view showing a section view through the approximate forward-to-back center of the inline clamp system; the view showing the pushrod of the shoe within a slot in the base; the view showing the flat and flush engagement between the scroll wheel and the base at the seamline between the lower surface of the scroll wheel and the upper surface of the base; the view showing the helical feature of the scroll wheel in full engagement with the teeth of the shoe on the forward side of the axis of rotation; the view showing the helical feature of the scroll wheel in full disengagement with the teeth of the shoe on the rearward side of the axis of rotation.
Figure 26B:
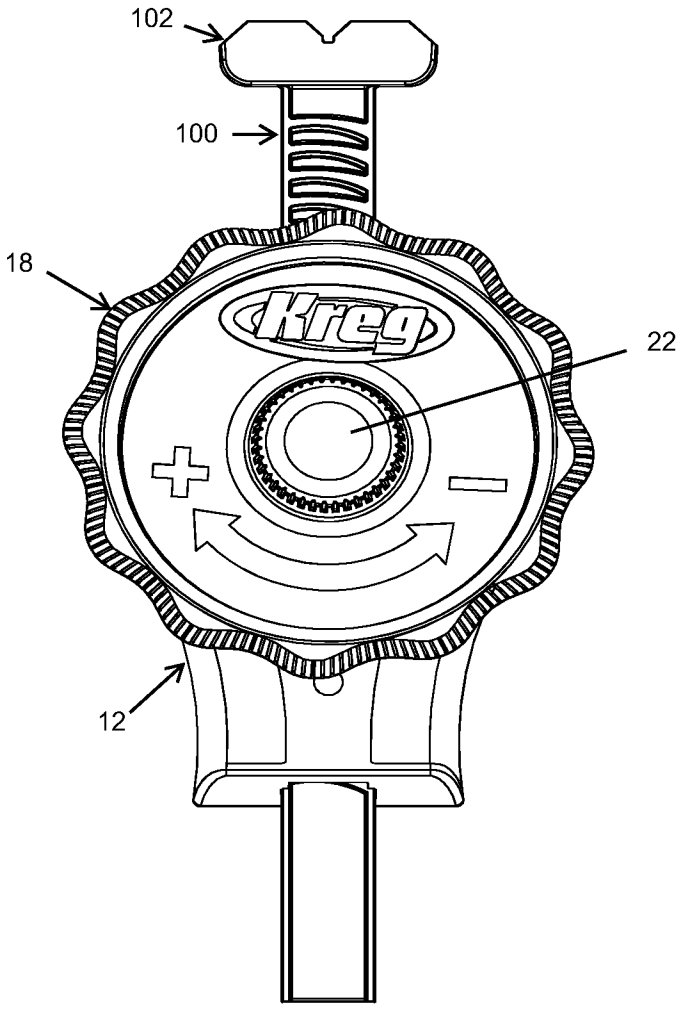
FIG. 26B is an elevation view of the upper surface of an inline clamp system, the view showing the base, the shoe, the scroll wheel and the cap in an assembled state, the view showing a dashed line that represents the approximate placement of the section view of FIG. 26A.

The flat forward wall 126 facilitates clamping or pushing of a workpiece that has a generally flat surface, such as an elongated board. In the arrangement shown, the outside corners of plunger 102 include angled walls 120 that form planes that are positioned in approximate perpendicular alignment to one another. These planes of angled walls 120 converge at approximately at centerline 128 of pushrod 100, as is shown in FIG. 17B. This arrangement facilitates clamping or pushing of an inside corner of a workpiece, such as where two straight workpieces come together at a right angle. By having the planes of angled walls 120 converge at the center of pushrod 100 this causes the forces on pushrod 100 to be balanced and provides stability to clamp system 10 when pressure is applied by pushrod 100 as well as properly align the workpiece.

In the arrangement shown, plunger 102 also includes a center recess 130 that facilitates clamping or pushing of an outside corner. In the arrangement shown, center recess 130 includes a pair of angled walls 132 that form planes that are positioned in approximate perpendicular alignment to one another. These planes of angled walls 132 converge at approximately at centerline 128 of pushrod 100, as is shown in FIG. 17B. This arrangement facilitates clamping or pushing of an outside corner of a workpiece, such as where two straight workpieces come together at a right angle. By having the planes of angled walls 132 converge at the center of pushrod 100 this causes the forces on pushrod 100 to be balanced and provides stability to clamp system 10 when pressure is applied by pushrod 100. In the arrangement shown, a relief notch 134 is positioned at the intersection of the angled walls 132 so as to provide additional room for woodchips or aberrations in the workpiece where the two boards connect, which is often present. The presence of relief notch 134 ensures that woodchips or aberrations at the intersection of the two boards does not cause misalignment.

Scroll Wheel:

With reference to FIGS. 3-7, a scroll wheel 18 is presented. Scroll wheel 18 is formed of any suitable size, shape and design and is configured to connect to base 12 and rotate thereon thereby extending or retracting shoe 14 with respect to base 12. In the arrangement shown, as one example, scroll wheel 18 when viewed from above or below has a generally circular shape with an upper surface 150 and a lower surface 152 that terminate in an exterior wall 154. Exterior wall 154 extends around upper surface 150 and lower surface 152 in an approximately circular manner and extends upward therefrom a distance before connecting to a grip feature 156. In the arrangement shown, the exterior wall 154 is approximately sized and shaped to correspond to the size and shape of the exterior wall 36 of base 12 such that when scroll wheel 18 is in place on top of the upper surface 38 of base 12 and the lower end of the exterior wall 154 of scroll wheel 18 is in approximate flush mating alignment with the upper end of exterior wall 36 of base 12. In this arrangement, the scroll wheel 18 engages the base 12 in a generally flat and flush engagement along a seamline 158 that extends in planar fashion between the two components.

The upper end of exterior wall 154 includes a grip feature 156. Grip feature 156 is any feature, device or configuration that helps provide increased grip of scroll wheel 18 so as to increase the ease of use and allow a user to apply the proper amount of torque onto scroll wheel 18 which is transmitted to linear pressure on shoe 14. In the arrangement shown, as one example, grip feature 156 includes a textured rib that extends upward and outward from the upper end of exterior wall 154. In the arrangement shown, as one example, grip feature 156 extends in a sinusoidal-like manner around the upper end of exterior wall 154. The texturing provides increased friction for a user's grasp. The undulating shape or features provide a comfortable grasp for a user's fingers as well as increased friction for a user's grasp. Any other configuration is hereby contemplated for grip feature 156 including outwardly extending spokes or posts that provide an increased moment arm to scroll wheel 18 which translates to a greater amount of torque applied to scroll wheel 18.

In the arrangement shown, as one example, the upper surface 150 of scroll wheel 18 also includes indicia 160 therein. Indicia 160 is any writing, inscription, label, picture or other visual that imparts a message to a user. In the arrangement shown, as one example, indicia 160 includes a double headed arrow that curves around the axis of rotation 84 that extends through the approximate center of scroll wheel 18. This curved arrow imparts the message to a user that scroll wheel 18 is to be rotated in either a clockwise or counterclockwise direction. Also, as is shown, a plus sign is positioned at one side of the double headed arrow and a minus sign is positioned at the side of the double headed arrow. The plus sign imparts the message to a user that rotating the scroll wheel 18 in the direction of the plus sign will increase extension of shoe 14 or increase pressure. In contrast the minus sign imparts the message to a user that rotating the scroll wheel 18 in the direction of the minus sign will decrease extension of shoe 14 or decrease pressure. Also present as indicia 160 is the name and logo of the manufacturer. Any other information or instructions may be presented as indicia and is hereby contemplated for use. Note the plus sign and minus sign may be replaced with a locked-lock symbol and an un-locked-lock symbol or any other related symbols.

In the arrangement shown, as one example, a tower 162 is positioned approximately at the center of scroll wheel 18 that extends upward from the upper surface 150 a distance before terminating in an upper end. Tower 52 is formed of any suitable size, shape and design and is configured to facilitate connection of scroll wheel 18 to base 12 while also facilitating rotation of scroll wheel 18 with respect to base 12. In the arrangement shown, tower 162 is generally cylindrical in shape and is configured to fit over the tower 52 of base 12 with close and tight tolerances that allow for rotation of scroll wheel 18 around tower 52 of base 12.

In the arrangement shown, as one example tower 18 includes a generally flat and smooth interior surface that angles inward slightly as it extends upward. This smooth inward surface of the tower 162 of scroll wheel 18 is sized and shaped to smoothly fit over and rotate over the smooth exterior surface of tower 52 of base 12. The close dimensional tolerances between the tower 162 of scroll wheel 18 and the tower 52 of base 12 provides precise alignment and guidance of the two components relative to one another. This precise alignment helps to align the axis of rotation 84 that extends through the approximate center of the tower 52 of base 12 and through the approximate center of the tower 162 of scroll wheel 18 such that the two components are in approximate axial alignment with one another around axis of rotation 84.

In the arrangement shown, the upper end of tower 162 includes an inward step 164 that connects to an opening 166 that connects to the hollow interior 168 of tower 162. Upper end of tower 162 serves as a stop surface for the reception of cap 22 and the opening 166 serves to receive a portion of cap 22 therein so as to facilitate connection of cap 22 to base 12 thereby holding scroll wheel 18 onto base.

In one arrangement, as is shown, the inward step 164 is sized and shaped to fit within the upper step 58 of tower 52 of base 12. As inward step 164 is narrower than the upper end of the hollow interior 168 of tower 162 of scroll wheel 18 when scroll wheel 18 is placed on tower 52 of base 12 the inward step 162 of scroll wheel 18 matingly engages the upper step 58 of tower 52 of base 12. As such, the engagement of the lower surface of inward step 162 serves as a stop surface when scroll wheel 18 is placed on tower 52 of base 12 as the lower surface of inward step 162 engages the upper surface of upper step 58. When scroll wheel 18 is placed on tower 52 of base 12 the inward step 164 fits as a collar around the upper step 58 of tower 52 of base 12 and facilitates rotation of scroll wheel 18 around the tower 52 of base 12. In addition, when scroll wheel 18 is placed on tower 52 of base 12 the upper end of tower 162 of scroll wheel 18 is in approximate flat and flush alignment with the upper end of tower 52 of base 12.

In one arrangement, as is shown, the exterior surface of tower 162 is generally cylindrical in shape and is positioned a distance inward from the interior side of exterior wall 154 so as to allow a user's fingers to reach within the exterior wall 154 and grasp tower 162. In the arrangement shown a portion of the exterior surface of tower 162 includes grip features 170. Grip feature 170 is any feature, device or configuration that helps provide increased grip of scroll wheel 18 so as to increase the ease of use and allow a user to apply the proper amount of torque onto scroll wheel 18 which is transmitted to linear pressure on shoe 14. In the arrangement shown, as one example, grip feature 170 includes a plurality of textured ribs that extends along the upper exterior surface of tower 162. The texturing provides increased friction for a user's grasp. Any other configuration is hereby contemplated for grip feature 170 including outwardly extending spokes or posts that provide an increased moment arm to scroll wheel 18 which translates to a greater amount of torque applied to scroll wheel 18.

Grasping tower 162 allows a user to impart fast rotations upon scroll wheel 18 or large movements of shoe 14 as rotating the scroll wheel 18 by the smaller-diameter tower 162 essentially has a lower gear ration than rotating the scroll wheel 18 by rotating the larger-diameter exterior wall 154. However, due to this lower gear ratio less torque may be imparted upon scroll wheel 18 by rotation of tower 162 as compared to rotating scroll wheel 18 by grip feature 156 of exterior wall 154 as the larger diameter of grip feature 156 of exterior wall 154 provides a greater moment and increased mechanical advantage. As such, rotating scroll wheel 18 using tower 162 provides fast and large movements of shoe 14 while rotating scroll wheel 18 using grip feature 156 of exterior wall 154 provides increased torque which is useful for tightening purposes.

Lower surface 152 of scroll wheel 18 includes helical feature 20 therein. In the arrangement shown, helical feature 20 is formed of one or more arcuate threads that extend downward from lower surface 152. In the arrangement shown, as one example, three threads are shown, however any other number of threads are hereby contemplated for use including, one, two, four, five, six, seven, eight, nine, ten or more. In the arrangement shown, each thread essentially forms a single rotation of scroll wheel 18, or slightly less, or slightly more, than a single rotation so as to allow entry and exit of teeth 16 into and out of helical feature 20 in a smooth manner, but again, any other arrangement is hereby contemplated for use. The threads of helical feature 20 are configured to engage and mesh with the teeth 16 of shoe 14 such that rotation of scroll wheel 18 causes linear movement of shoe 14. Each thread begins at one diameter of scroll wheel 18 and terminates at a second diameter of scroll wheel 18 which is what causes linear movement of shoe 14 as scroll wheel 18 is rotated.

Figure 5:
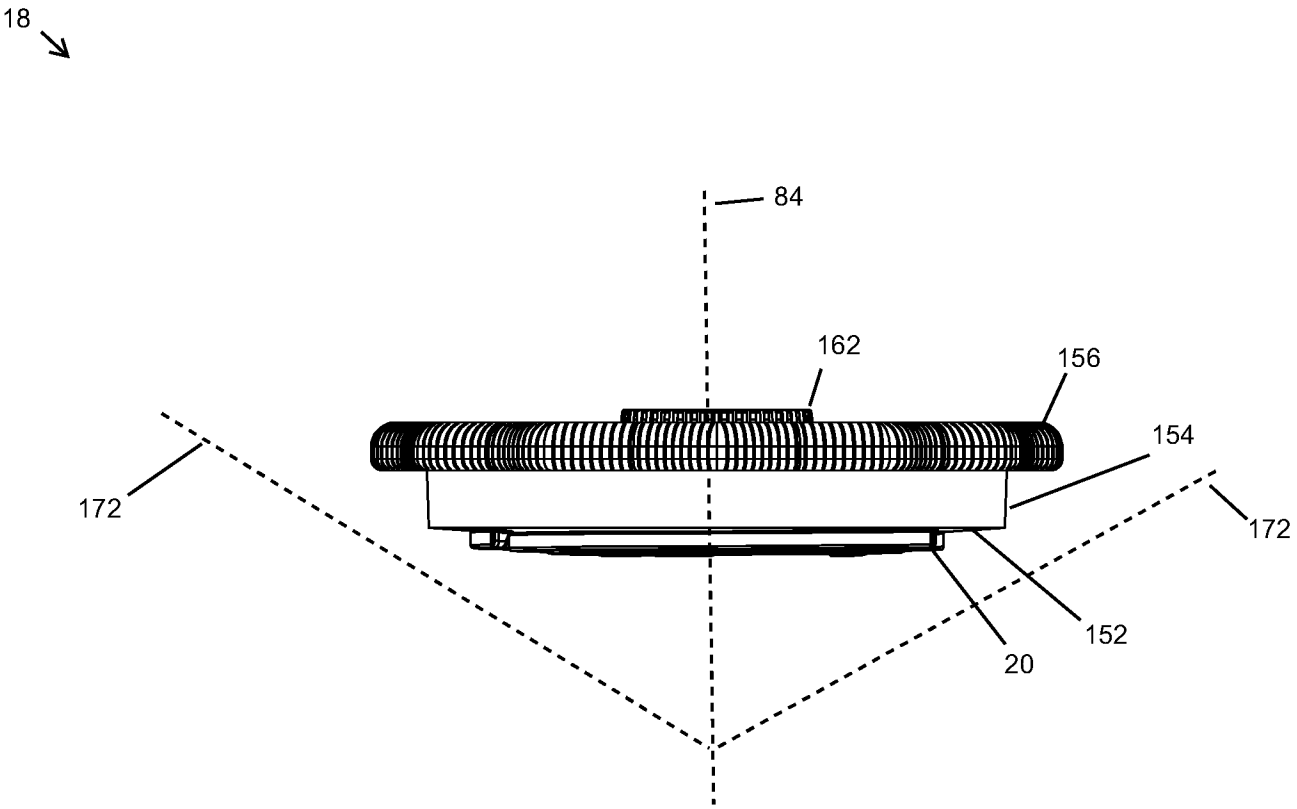
FIG. 5 is a side elevation view of a scroll wheel for use with an inline clamp system, the view showing the lower surface of the scroll wheel; the view showing a helical feature positioned in the lower surface of the scroll wheel; the view showing a grip feature connected to an exterior wall of the scroll wheel.
Figure 6:
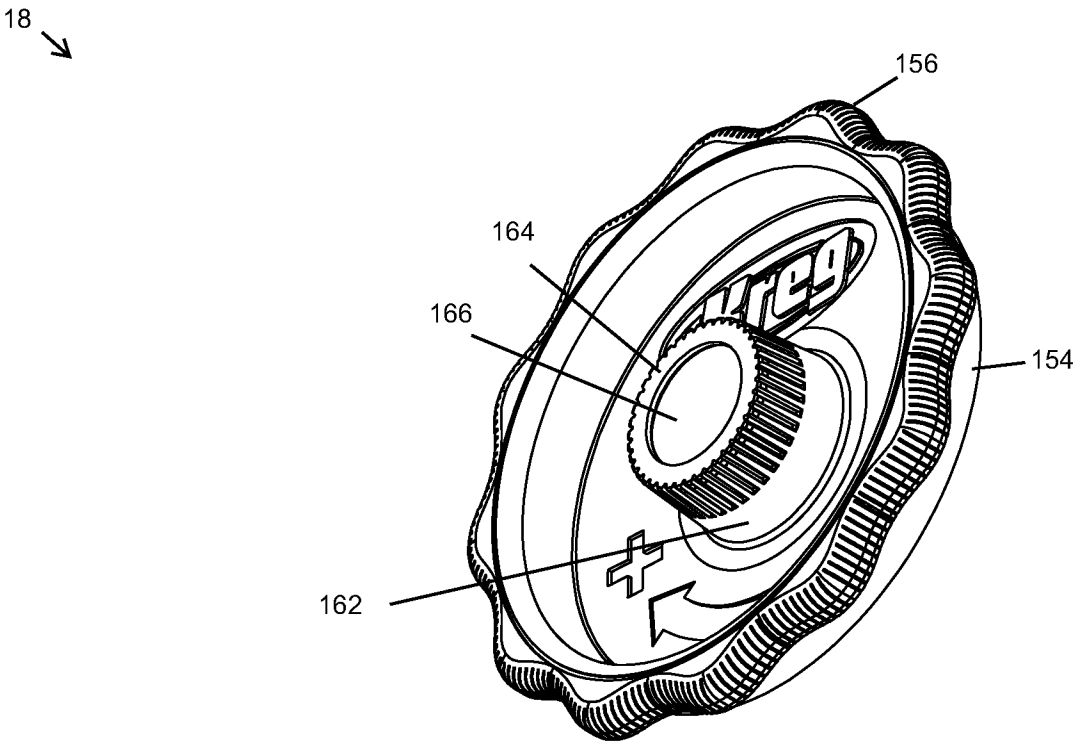
FIG. 6 is a perspective view of the upper surface of a scroll wheel for use with an inline clamp system, the view showing the upper surface of the scroll wheel, a grip feature connected to an exterior wall, a tower extending upward from the upper surface with an opening positioned at its middle, and indicia positioned in the upper surface.

To facilitate linear movement of shoe 14 by rotation of scroll wheel 18, helical feature 20 engages teeth 16 of shoe 14 on one side of tower 52/162 while helical feature 20 is free from engagement with teeth 16 of shoe 14 on an opposite side of tower 52/162. To facilitate this engagement on one side of tower 52/162 but not the other side in the arrangement shown the lower surface 152 of scroll wheel 18 is conical in shape or cone shaped. That is, the lower surface 152 angles slightly downward as it extends from its outward edge towards the center of scroll wheel 18 or axis of rotation 84. It is contemplated that this angle may be anywhere from zero degrees to thirty degrees and any angle or range of angles between one and thirty degrees is hereby contemplated for use including between one degree and twenty degrees, between one degree and ten degrees, between one degree and five degrees, and between three degrees and five degrees. In one arrangement an angle of approximately four degrees has been tested with success, which is approximately what is shown in FIG. 5. With further reference to FIG. 5, the conical taper of lower surface 152 is shown in an accentuated and emphasized manner for demonstrative purposes as the dashed lines 172 that converge at axis of rotation 84 that extends through the center of scroll wheel 18.

In one arrangement, as is shown, as one example, the angle of taper of the lower surface 152 corresponds with or is equal to or approximately equal to the angle between the edge or conical surface of upper surface 38 and lower surface 40 of base 12. This is represented as angle "a" (or ninety degrees minus "a") on FIG. 12. However, again, any other angle is hereby contemplated for use.

Figure 28:
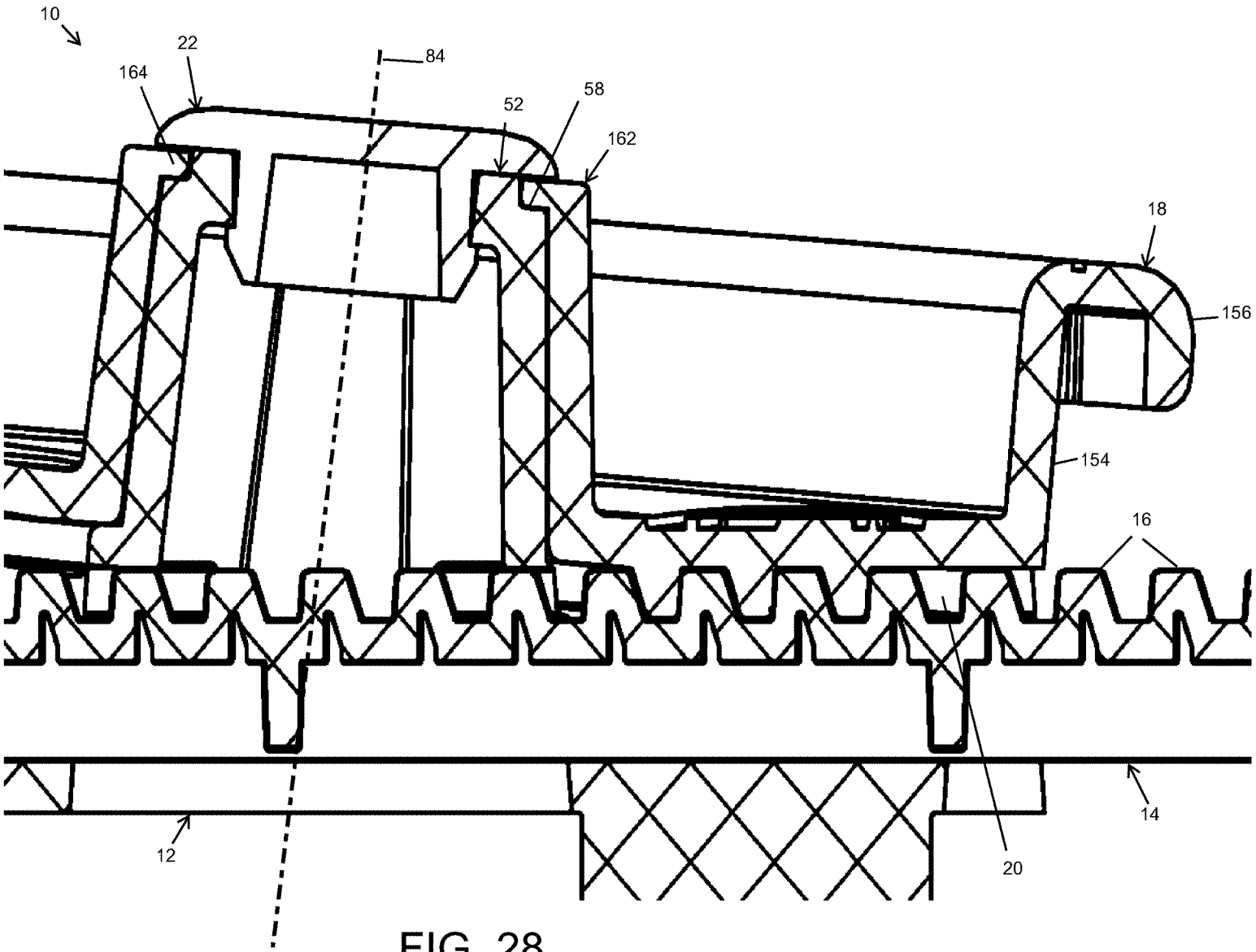
FIG. 28 is a close up view of FIG. 27, the view showing the helical feature of the scroll wheel in full engagement with the teeth of the shoe on the forward side of the axis of rotation.

With reference to FIG. 28, by forming lower surface 152 of scroll wheel 18 in a cone-shaped manner and by placing the axis of rotation 84 at a corresponding angle to the upper wall 108 of shoe 14 this facilitates flat and flush meshing engagement between the helical feature 20 of scroll wheel 18 with the teeth 16 in the upper wall 18 of shoe 14 on one side of the axis of rotation 84 (which in the arrangement shown is the forward side of the axis of rotation 84). That is, there is full contact and meshing engagement between the helical feature 20 and teeth 16 along the majority of or all of lower surface 152 of scroll wheel 18 on one side (the forward side) of the axis of rotation 84. That is, at the center of the length of shoe 14 the plane of lower surface 152 of scroll wheel 18 is in parallel spaced alignment with the upper wall 108 of pushrod 100 of shoe 14. This planar alignment, at the center of the length of shoe 14 provides full engagement of teeth 16. Also, in one arrangement at the center of the length of shoe 14 the plane of lower surface of helical feature 20 of scroll wheel 18 is in parallel spaced alignment with the upper surface of teeth 16 of pushrod 100 of shoe 14. Simultaneously, with reference to FIG. 29, by forming lower surface 152 in a cone-shaped manner, that tapers at a slight angle, and by placing the axis or rotation 84 at an angle to the upper wall 108 of shoe 14 this facilitates complete clearance between the helical feature 20 of scroll wheel 18 and the teeth 16 in the upper wall 18 of shoe 14 on an opposite side of the axis of rotation 84 (which in the arrangement shown is the rearward side of the axis of rotation 84). As an example, when the angle of the lower surface 152 is four degrees, and the axis of rotation is similarly positioned at four degrees from perpendicular (that is, when viewed from the side, the axis of rotation leans four degrees forward from perpendicular, or at eighty-six degrees) this provides eight degrees of clearance on the opposite side of the axis of rotation 84.

In an alternative arrangement, lower surface 152 may be flat and planar in shape. In this arrangement, lower surface 152 is placed at an angle to the plane formed by upper wall 108 of pushrod 100. While this arrangement with a planar lower surface 152 may be functional in some applications, it suffers from the deficiency that the helical feature 20 and teeth 16 will not be in full and flush contact and meshing engagement along the lower surface 152 of scroll wheel 18. As an example, when viewed from the side, if the scroll wheel 18 is positioned at a slight angle to perpendicular (such as leaning four degrees forward when viewed from the side) the forward most portion of helical feature 20 will be at the fullest engagement with teeth 16 with there being less and less engagement between the helical feature 20 and the teeth 16 as you move rearward. This lack of full engagement may lead to excess wear, performance issues, failure to facilitate torque transfer and premature failure, among other disadvantages. However, this flat but angled arrangement may be sufficiently functional in some applications.

Figure 4:
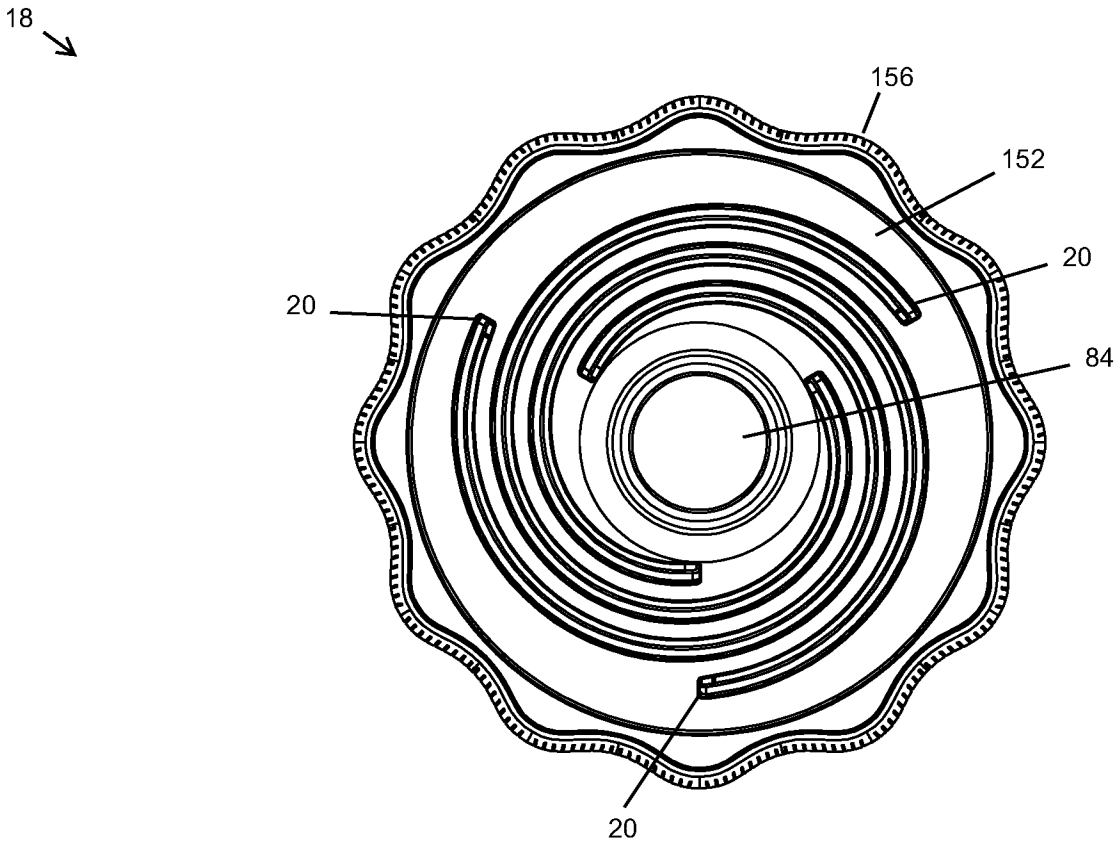
FIG. 4 is a is an elevation view of the lower surface of a scroll wheel for use with an inline clamp system, the view showing the lower surface of the scroll wheel; the view showing a helical feature positioned in the lower surface of the scroll wheel, the helical feature formed of three curved members that extend around a centrally positioned opening in the scroll wheel; the view showing a grip feature connected to an exterior wall of the scroll wheel.
Figure 7:
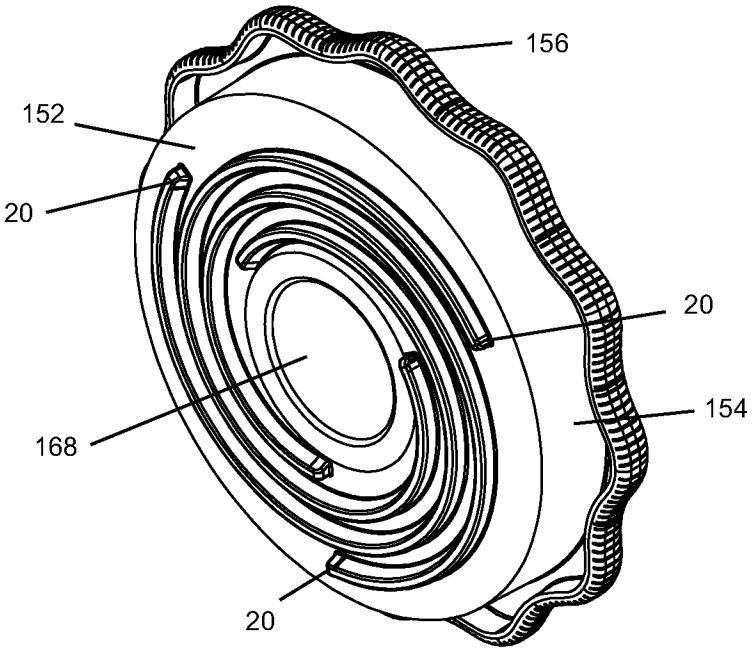
FIG. 7 is a perspective view of the lower surface of a scroll wheel for use with an inline clamp system, the view showing the lower surface of the scroll wheel; the view showing a helical feature positioned in the lower surface of the scroll wheel, the helical feature formed of three curved members that extend around a centrally positioned opening in the scroll wheel; the view showing a grip feature connected to an exterior wall of the scroll wheel.
Figure 8:
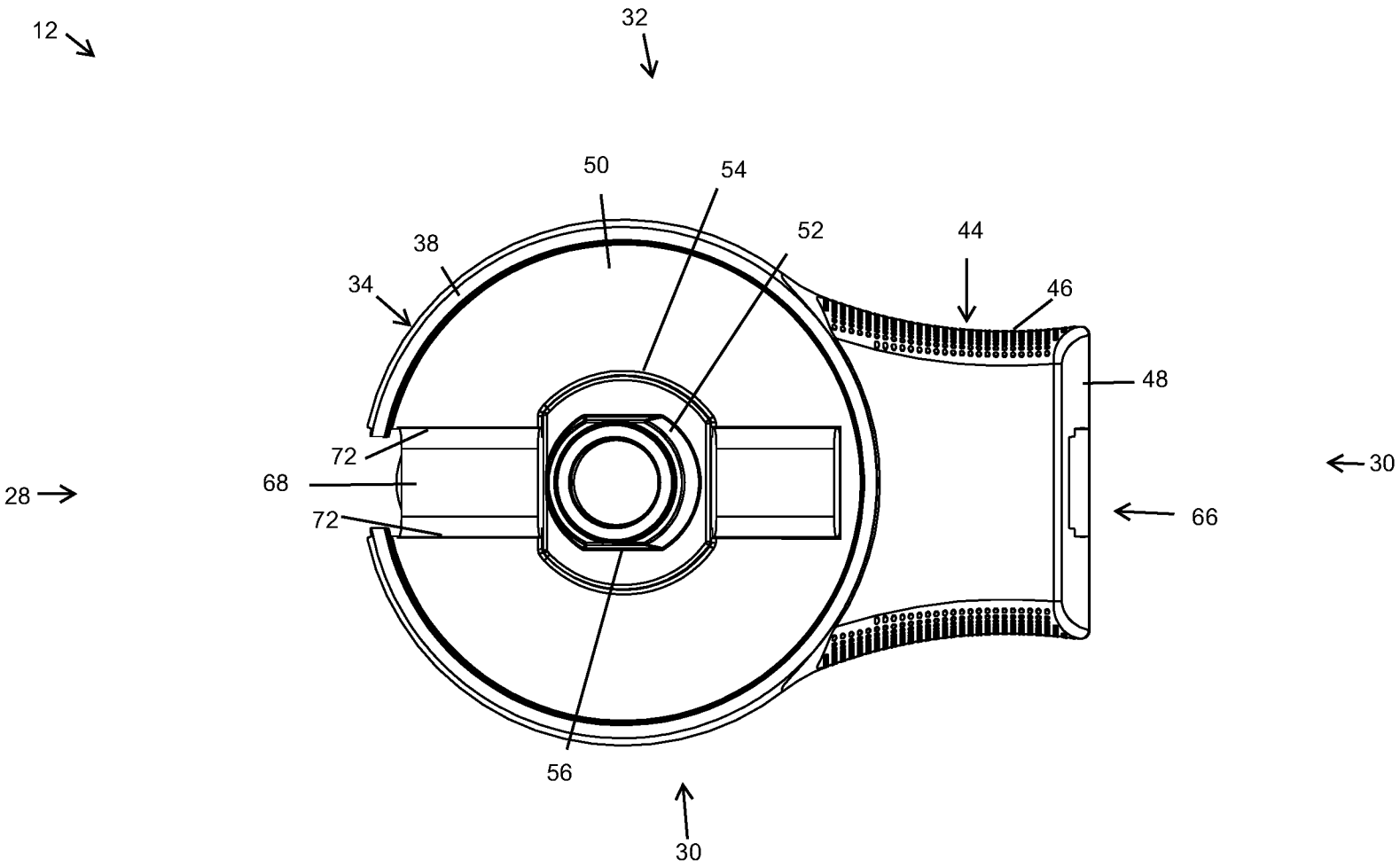
FIG. 8 is an elevation view of the upper surface of a base for use with an inline clamp system, the view showing the main body of the base having a generally circular shape; the view showing the tail section connected to the main body of the base and trailing rearward therefrom; the view showing the slot extending through the base from the forward side to the rearward side that is sized and shaped to receive the pushrod of a shoe; the view showing a tower extending upward from approximately the center of a recessed area with the lower end of the tower connected to a platform that bridges the slot.
Figure 9:
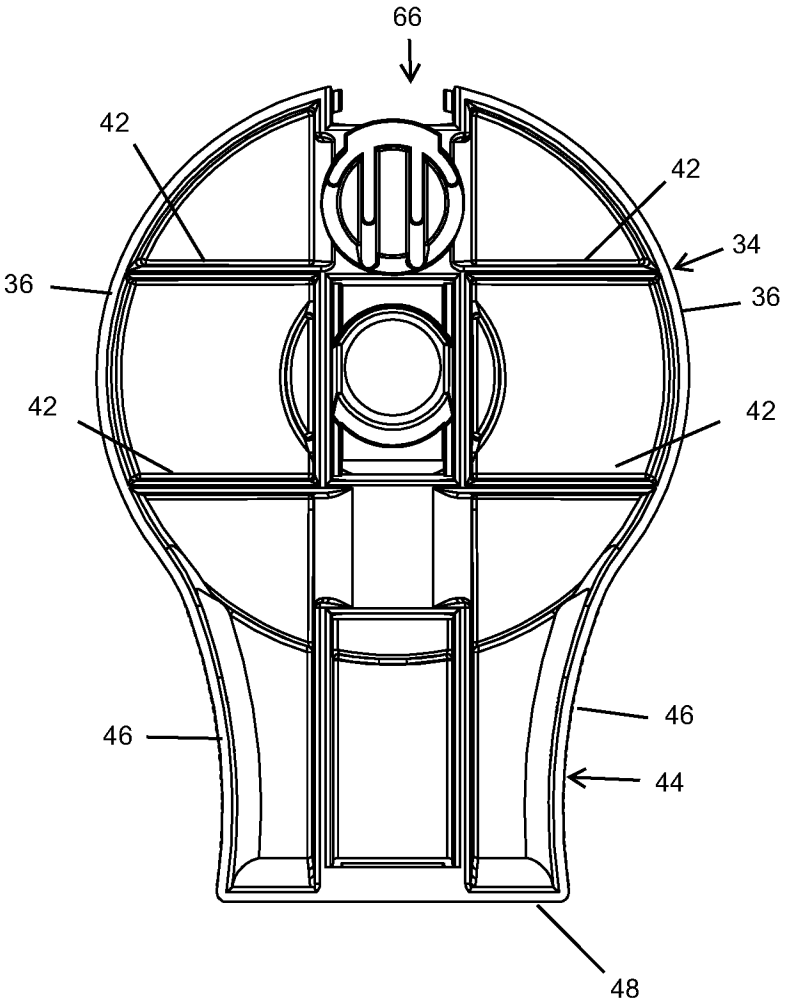
FIG. 9 is an elevation view of the bottom surface of a base for use with an inline clamp system, the view showing the main body of the base having a generally circular shape; the view showing the tail section connected to the main body of the base and trailing rearward therefrom; the view showing the slot extending through the base from the forward side to the rearward side that is sized and shaped to receive the pushrod of a shoe; the view showing a plurality of structural features extending through the base.
Figure 10:
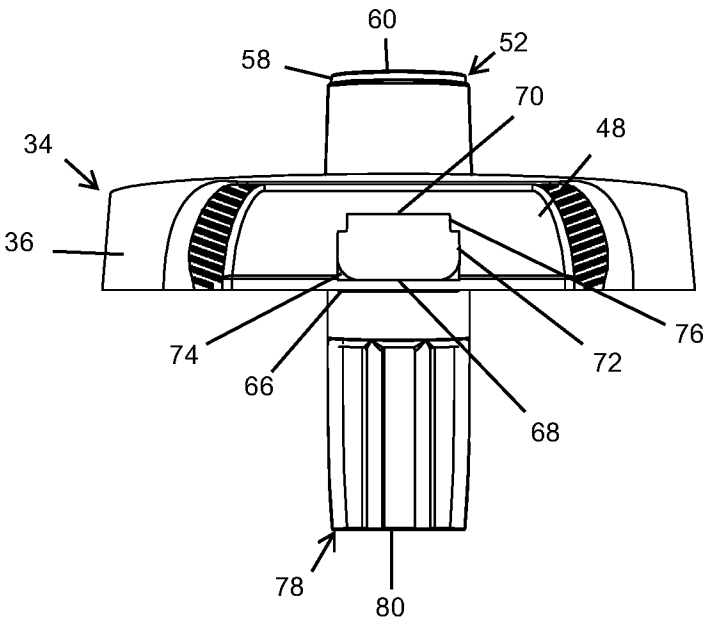
FIG. 10 is an elevation view of the rear side of a base for use with an inline clamp system, the view showing the main body of the base having a generally circular shape; the view showing the tail section connected to the main body of the base and trailing rearward therefrom; the view showing the slot extending through the base from the forward side to the rearward side that is sized and shaped to receive the pushrod of a shoe; the view showing a post extending downward from the lower surface of the base.
Figure 11:
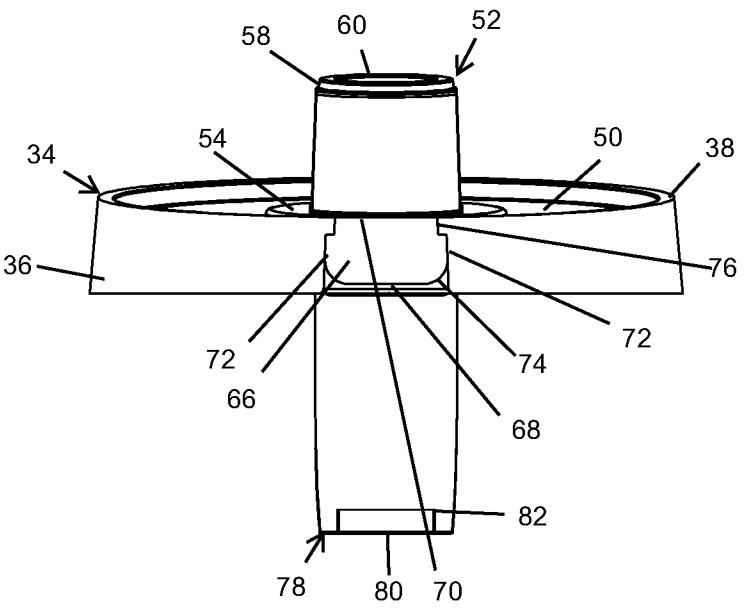
FIG. 11 is an elevation view of the front side of a base for use with an inline clamp system, the view showing the main body of the base having a generally circular shape; the view showing the slot extending through the base from the forward side to the rearward side that is sized and shaped to receive the pushrod of a shoe; the view showing a post extending downward from the lower surface of the base.

With reference to FIGS. 4 and 7, helical feature 20 is formed of three threads. Each of these start and stop at different portions of the circumference of scroll wheel 18. This staggering of the start and end of the multiple threads of helical feature 20 along with the use of multiple threads ensures that at all times the helical feature 20 engaged with multiple teeth 16 of pushrod 100 which facilitates smooth and even and consistent operation as new teeth 16 are engaged and previously engaged teeth 16 are released intermittently as the scroll wheel 18 is rotated. As the scroll wheel 18 is rotated, the multiple threads of helical feature 20 stagger the reception of new teeth 16 and the release of previously engaged teeth 16. This facilitates smooth and consistent operation along the entire range of the extension and retraction of shoe 14. To further smooth and ease the operation of engaging new teeth 16 and releasing engaged teeth 16 the leading and/or trailing ends of helical feature 20 are rounded, pointed or angled so as to ensure the helical feature 20 smoothly enters the space between adjacent teeth 16 and smoothly releases an engaged tooth 16.

Cap:

Cap 22 is formed of any suitable size, shape and design and is configured to connect to tower 52 of base 12 thereby holding scroll wheel 18 to base 12 while allowing rotation of scroll wheel 18 with respect to base 12. In the arrangement shown, as one example, when viewed from above or below, cap 22 is generally cylindrical in shape and includes an upper surface 200 and a lower surface 202 that extend in approximate parallel spaced relation to one another. In the arrangement shown, a collar 204 extends downward from the lower surface 202 of cap 22. Collar 204 is generally circular in shape when viewed from below and includes an angled edge 206 at its lower end. In the arrangement shown, angled edge 206 angles outward as it extends upward toward lower surface 202 before terminating in a lip 208. In the arrangement shown, the upper surface of lip 208 extends in approximate parallel space alignment to the upper surface 200 and lower surface 202 of cap 22. In the arrangement shown, the upper surface of lip 208 extends in approximate perpendicular alignment to the exterior surface of collar 204 of cap 22.

Figure 29:
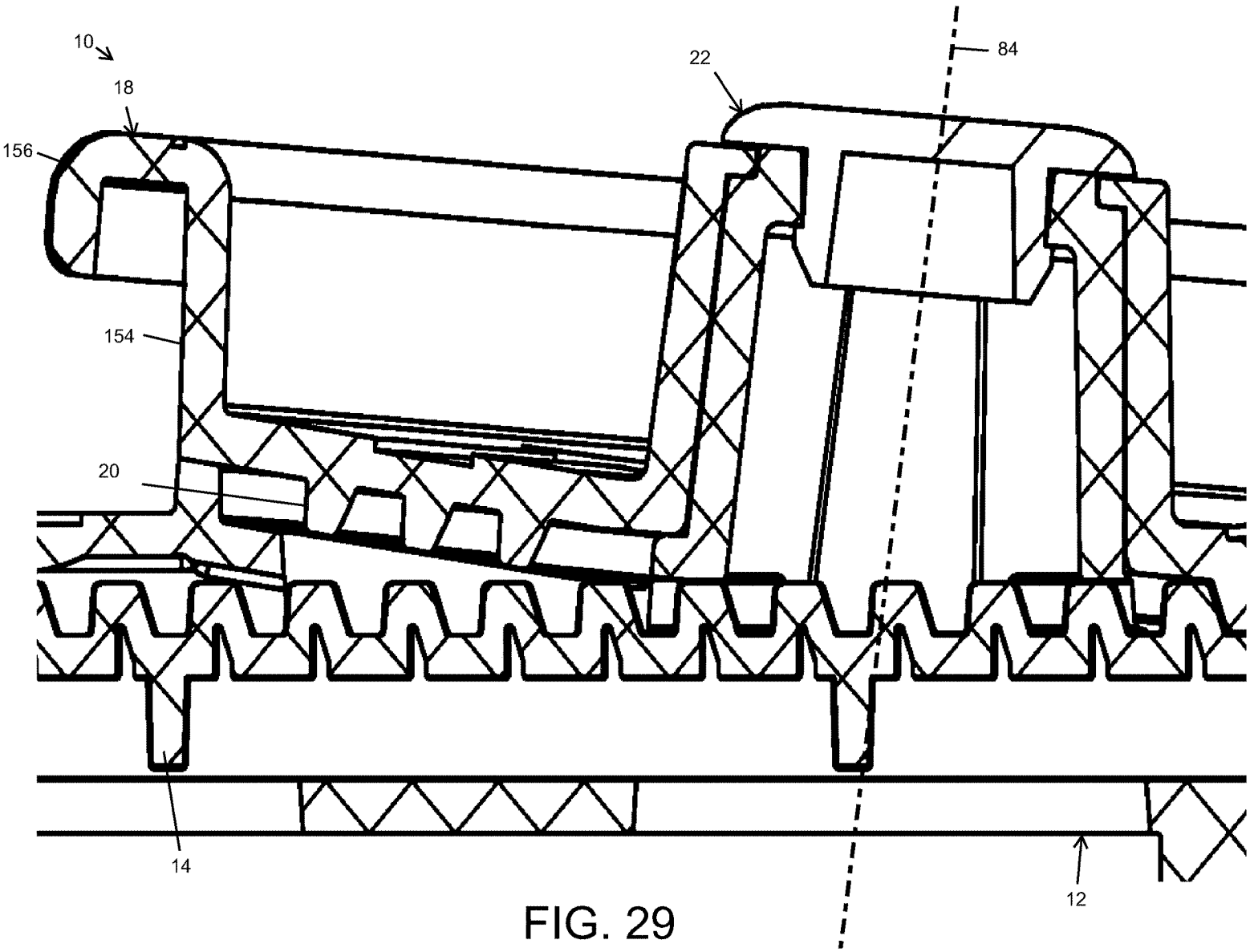
FIG. 29 is a close up view of FIG. 27, the view showing the helical feature of the scroll wheel in full disengagement with the teeth of the shoe on the rearward side of the axis of rotation.
Figure 30A:
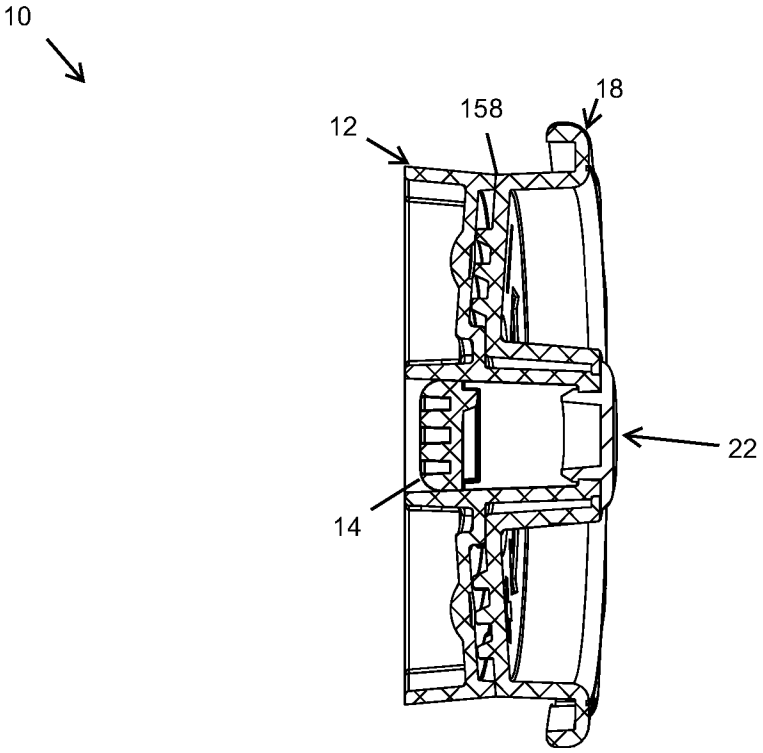
FIG. 30A is a side elevation view of an inline clamp system, the view showing the base, the shoe, the scroll wheel and the cap in an assembled state, the view showing a section view through the approximate side-to-side center of the inline clamp system; the view showing the pushrod of the shoe within a slot in the base; the view showing the flat and flush engagement between the scroll wheel and the base at the seamline between the lower surface of the scroll wheel and the upper surface of the base.
Figure 30B:
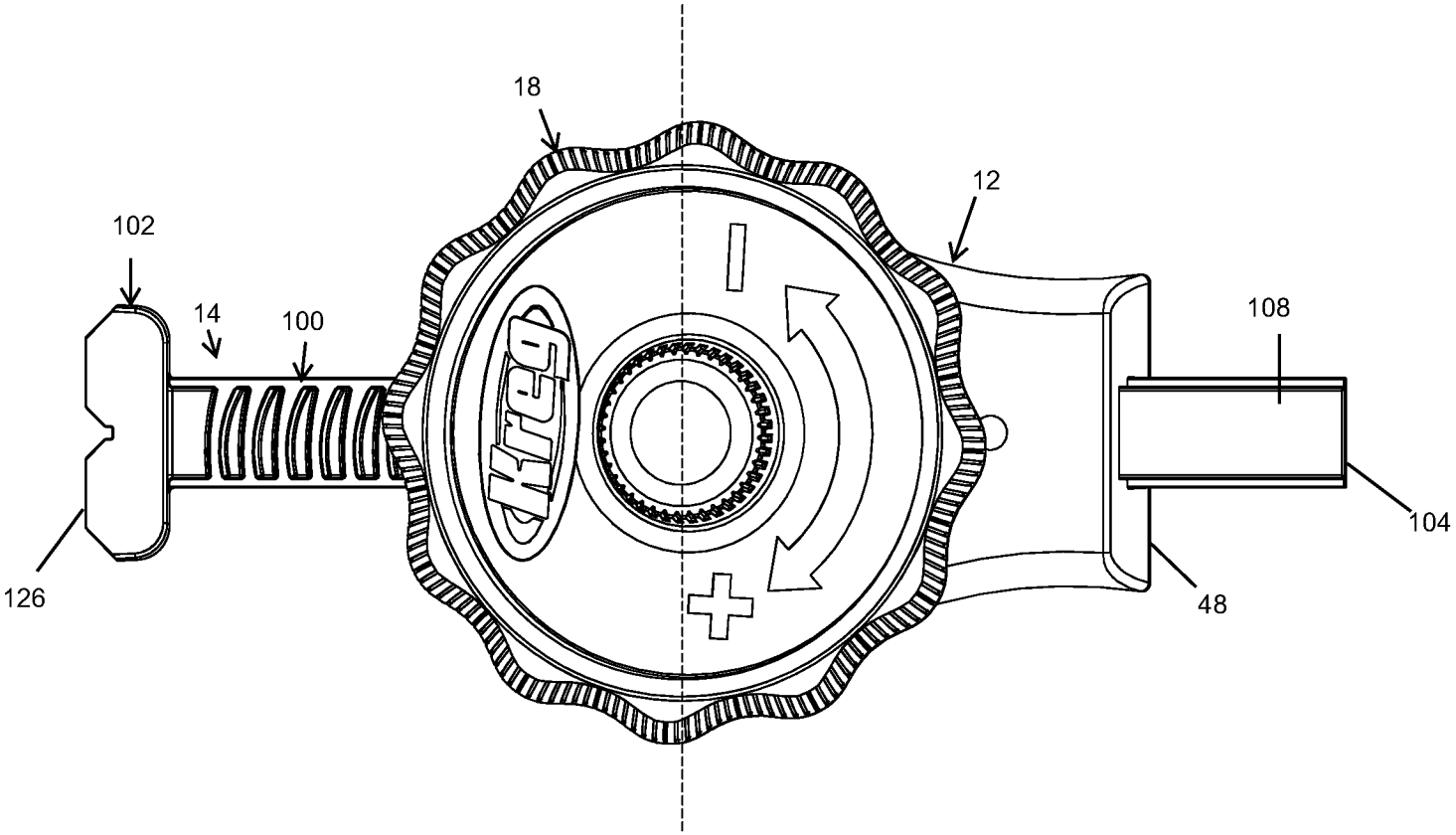
FIG. 30B is an elevation view of the upper surface of an inline clamp system, the view showing the base, the shoe, the scroll wheel and the cap in an assembled state, the view showing a dashed line that represents the approximate placement of the section view of FIG. 30A.
Figure 31:
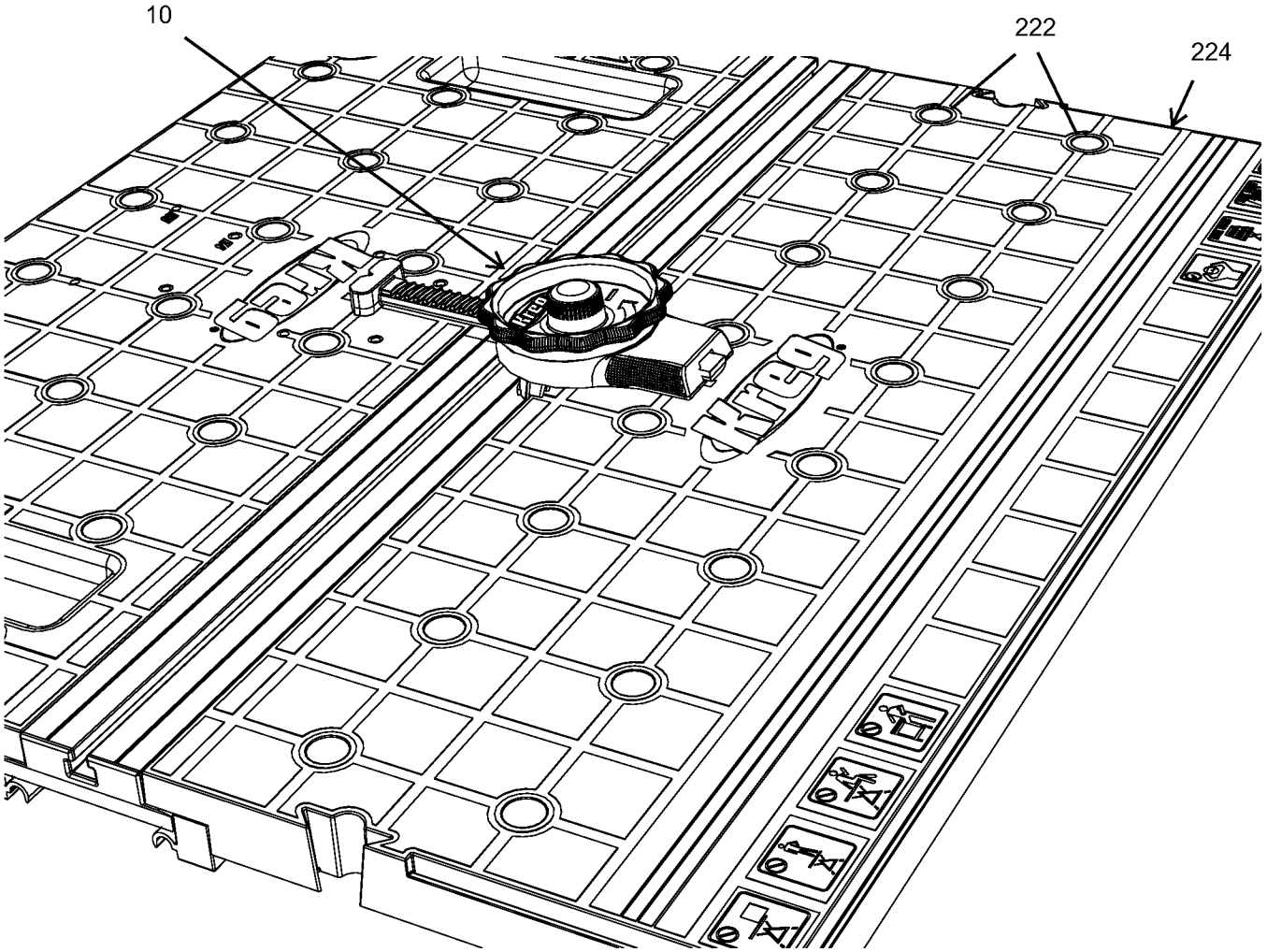
FIG. 31 is a perspective view of an inline clamp system, the view showing the base, the shoe, the scroll wheel and the cap in an assembled state, the view showing the post of the base inserted within an opening in a support surface, which is a workbench; the view showing the shoe in a partially extended state.
Figure 32:
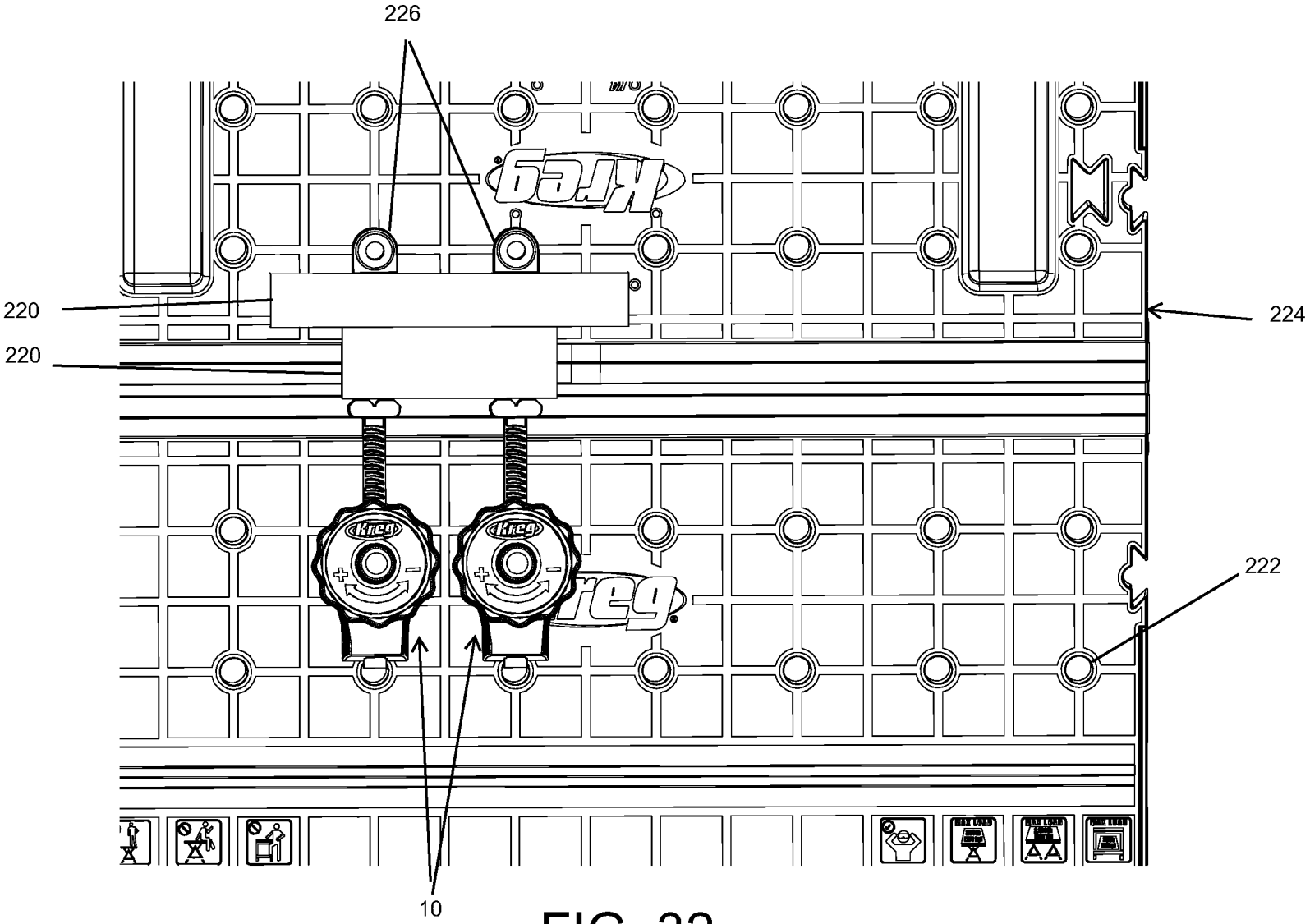
FIG. 32 is an elevation view of a pair of inline clamp systems, the view showing the base, the shoe, the scroll wheel and the cap in an assembled state, the view showing the posts of the bases inserted within an opening in a support surface, which is a workbench; the view showing the shoes in a partially extended state and pushing a pair of workpieces against a pair of stops.
Figure 33:
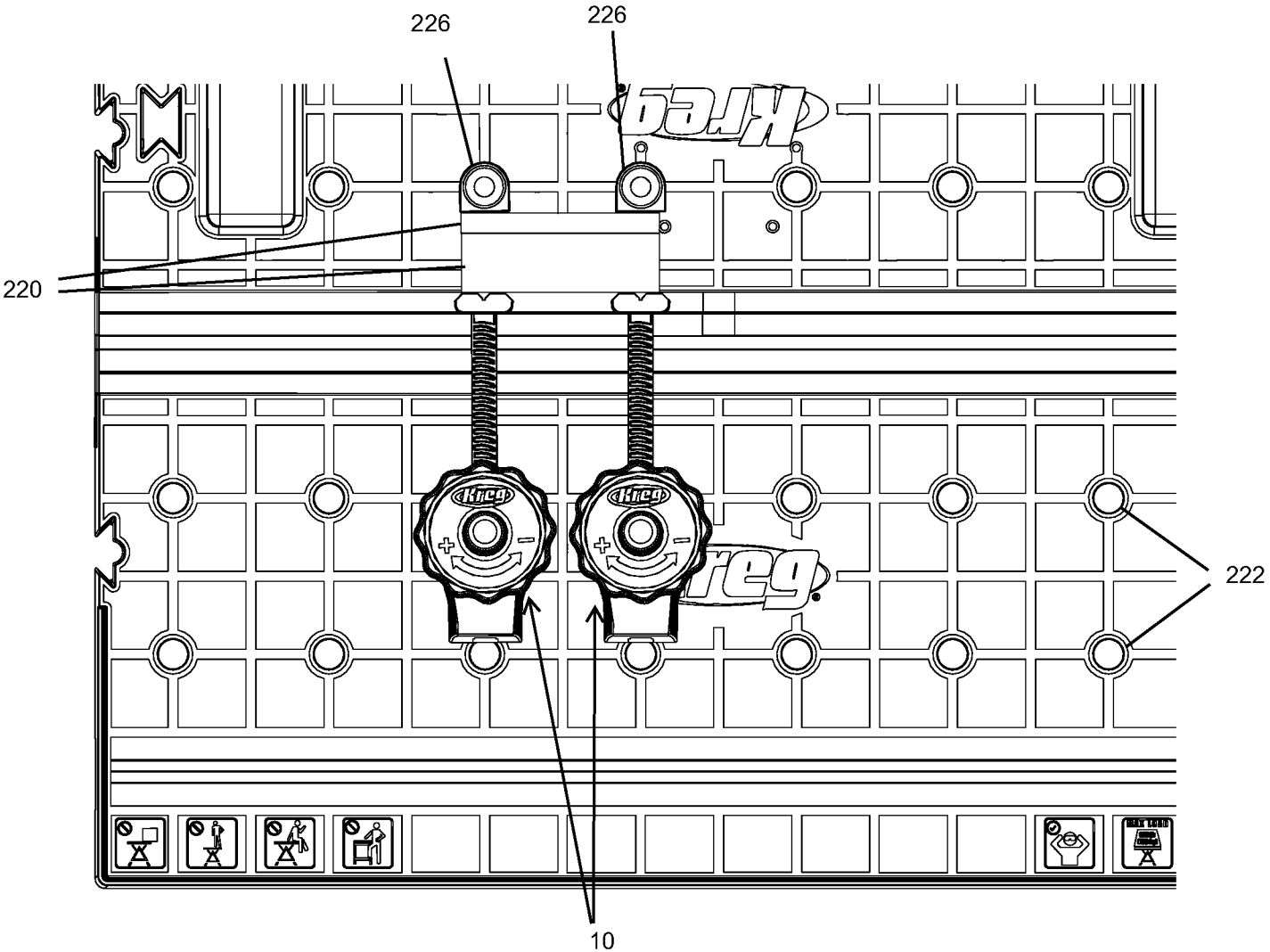
FIG. 33 is an elevation view of a pair of inline clamp systems, the view showing the base, the shoe, the scroll wheel and the cap in an assembled state, the view showing the posts of the bases inserted within an opening in a support surface, which is a workbench; the view showing the shoes in a mostly extended state and pushing a pair of workpieces against a pair of stops.
Figure 34:
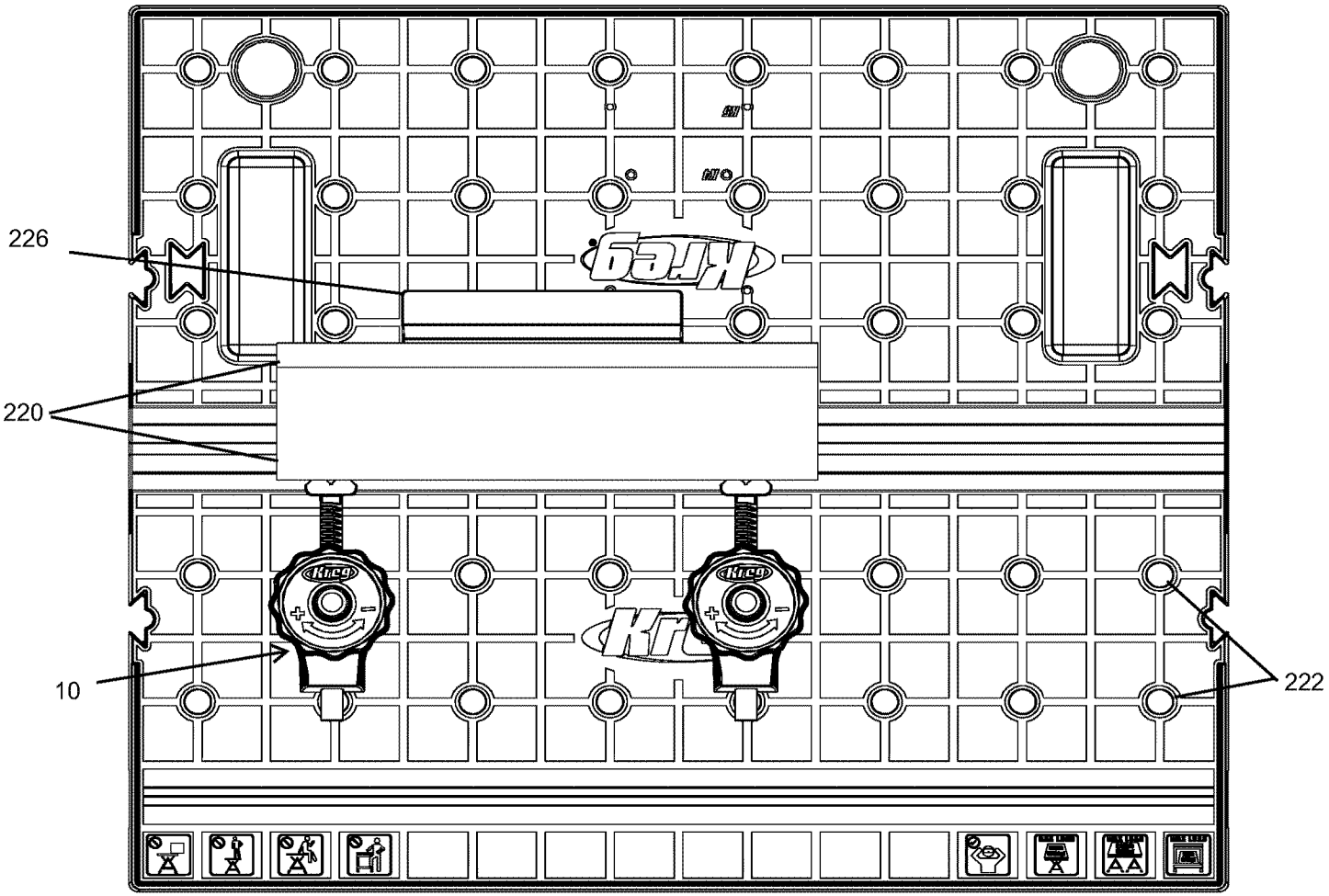
FIG. 34 is an elevation view of a pair of inline clamp systems, the view showing the base, the shoe, the scroll wheel and the cap in an assembled state, the view showing the posts of the bases inserted within an opening in a support surface, which is a workbench; the view showing the shoes in a partially extended state and pushing a pair of workpieces against a single elongated stop.
Figure 35:
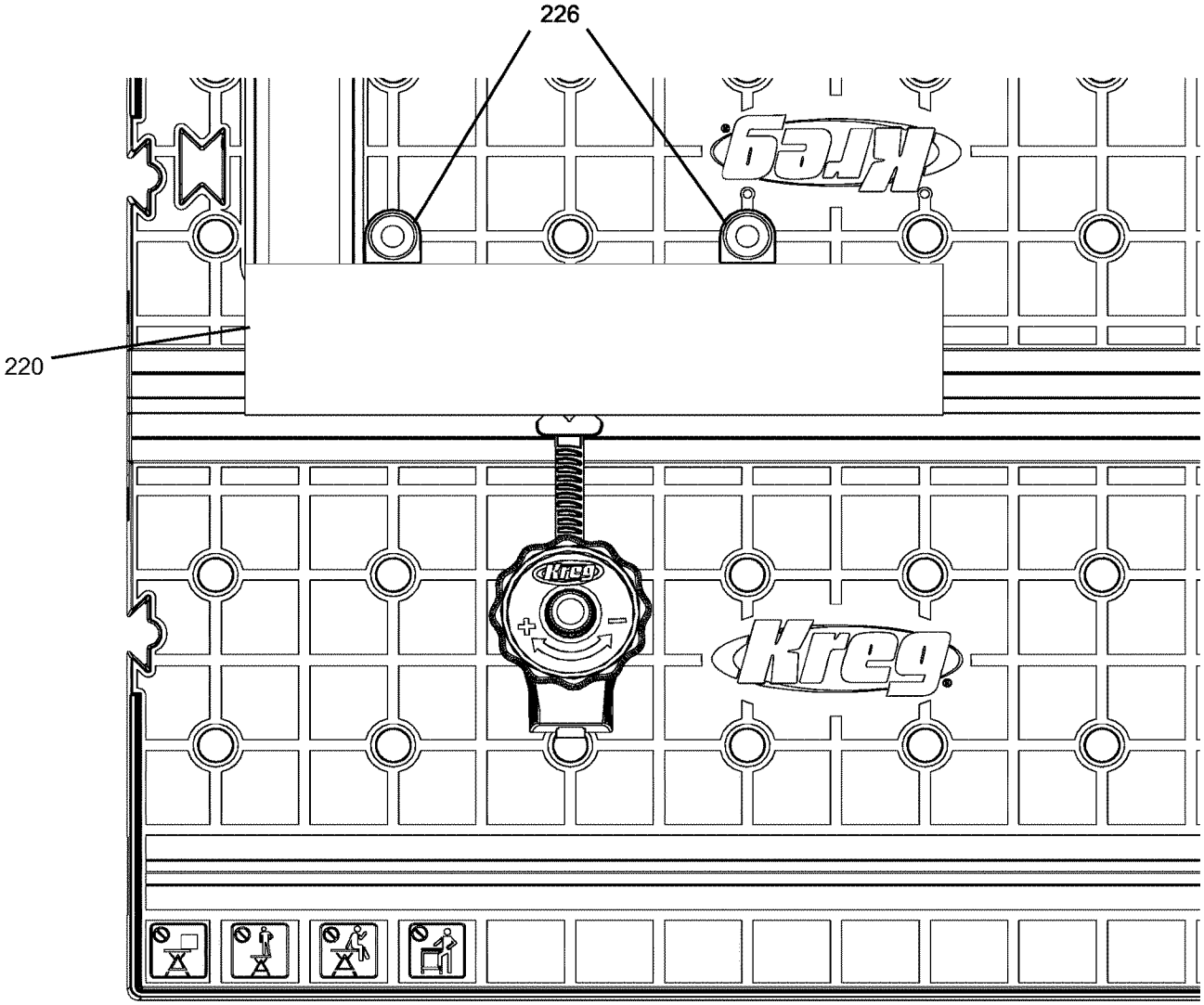
FIG. 35 is an elevation view of an of inline clamp system, the view showing the base, the shoe, the scroll wheel and the cap in an assembled state, the view showing the post of the base inserted within an opening in a support surface, which is a workbench; the view showing the shoe in a partially extended state and pushing a pair of workpieces against a pair of stops.
Figure 36:
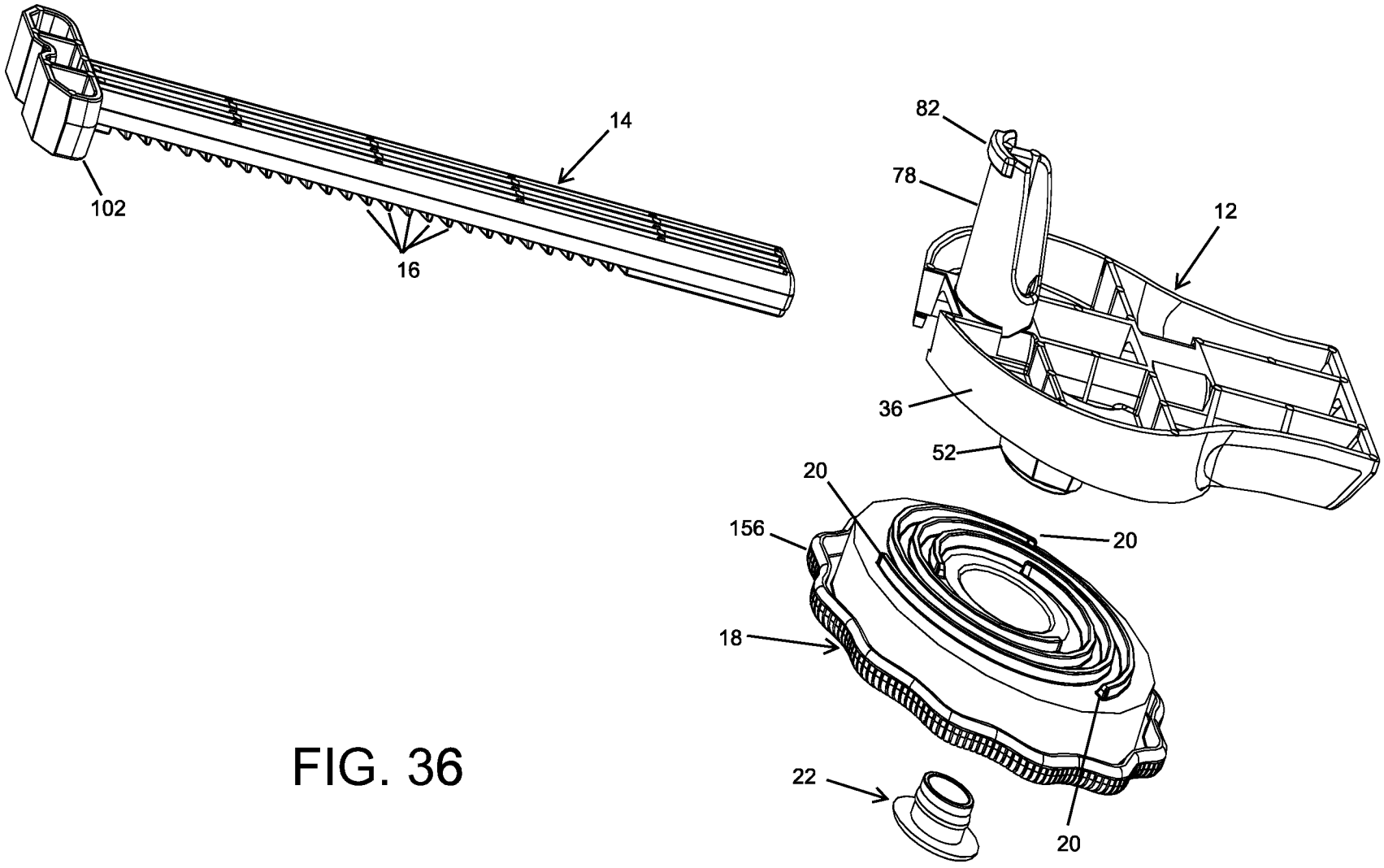
FIG. 36 is a is an exploded perspective view of an inline clamp system, the view showing the base, the shoe, the scroll wheel and the cap exploded from one another, the view being similar to that of FIG. 2, only from a bottom side of the inline clamp system.
Figure 37:
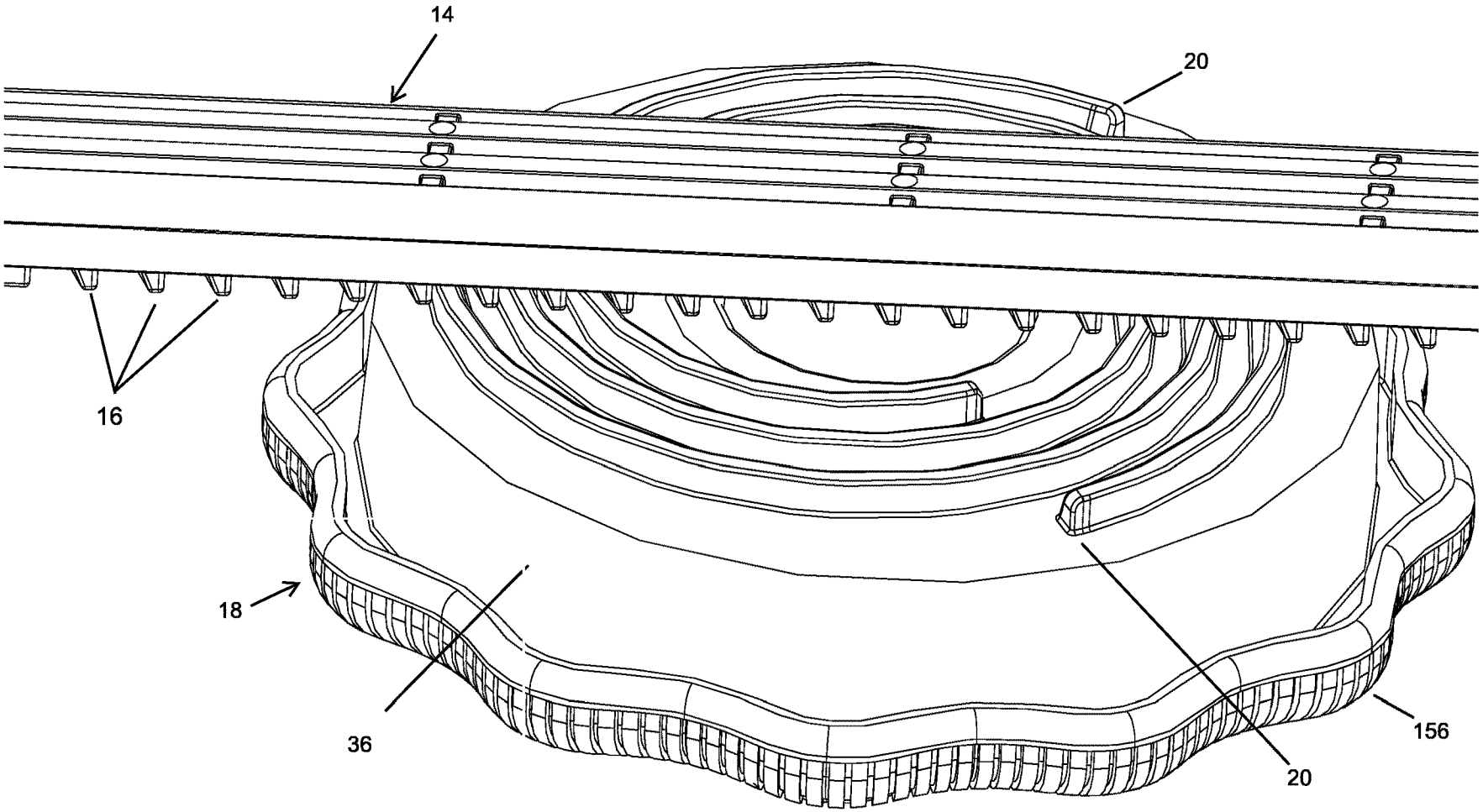
FIG. 37 is a bottom perspective view showing the helical feature of the scroll wheel engaged with the teeth of the pushrod on one side of the axis of rotation, the view showing the base removed so as to reveal the helical feature of the scroll wheel.

The angle of angled surface 206 helps to guide the lower end of collar 204 into the opening 60 of tower 52 of base 12. As is best depicted in FIGS. 28 and 29, the maximum exterior diameter lip 208 is greater than the interior diameter of opening 60 of tower 52 of base 12. As such, when cap 22 is inserted within opening 60 of tower 52 of base 12 the collar 204 frictionally engages the interior diameter of opening 60 of tower 52 of base 12 until force is applied that overcomes the friction between the exterior diameter of lip 208 and opening 60 of tower 52 of base 12. Once cap 22 sufficiently flexes or bends or compresses under appropriate pressure lip 208 passes the lower step 62 of tower 52 the upper surface of lip 208 engages the lower surface of lower step 62 in a flat and flush engagement thereby preventing removal of cap 22 from tower 52. As the exterior diameter of the upper surface 200 and lower surface 202 of cap 22 is greater than the interior diameter of opening 166 in the upper end of tower 162 of scroll wheel 18 when cap 22 is in place over scroll wheel 18 cap 22 holds scroll wheel in place on tower 52 while allowing rotation of cap 22 and/or scroll wheel 18.

Any other configuration or arrangement is hereby contemplated for connecting scroll wheel 18 to tower 52 of base 12. Alternative arrangements include a screw or bolt and nut arrangement, a snap fit arrangement where the scroll wheel 18 itself snaps into place on tower 52 of base 12, or any other manner, method or means of connecting the two components together.

Assembly:

In the arrangement shown, as one example, the inline clamp system 10 is assembled by inserting shoe 14 into slot 66 of base 12 and by placing scroll wheel 18 on base 12. This is accomplished by aligning the interior surface of hollow interior 168 of tower 162 of scroll wheel 18 with the exterior surface of tower 52 of base 12. Once tower 162 of scroll wheel 18 is aligned with the tower 52 of base 12 the scroll wheel 18 is lowered onto the exterior surface of tower 52 of base 12. Scroll wheel 18 is lowered until: the lower surface of inward step 164 is in flat and flush mating engagement with the upper surface of upper step 58 of tower 52 of base 12; the interior surface of tower 162 is in flat and flush mating engagement with the exterior surface of tower 52 of base 12; the inward portion of lower surface 152 of scroll wheel 18 is in flat and flush mating engagement with the upper surface of platform 54 of base 12; and/or the outward portion of lower surface 152 of scroll wheel 18 is in flat and flush mating engagement with the upper surface 38 of base 12 at seamline 158.

Once in this position, cap 22 is placed over the upper surface of the overlapping towers 52, 162 and the lower end of collar 204 is inserted within opening 60 of tower 52 of base 12. When the collar 204 frictionally engages the interior diameter of opening 60 of tower 52 of base 12 force is applied to overcome the friction until the lip 208 passes the lower step 62 of tower 52 at which point the upper surface of lip 208 engages the lower surface of lower step 62 in a flat and flush engagement thereby preventing removal of cap 22 from tower 52. Once cap is in this position, the scroll wheel 18 is held in place on base 12 as the exterior diameter of cap 22 is greater than the interior diameter of tower 162 of scroll wheel 18.

Shoe 14 is inserted into base 12 by aligning the rear end of pushrod 100 with slot 66 of base 12. Once aligned, the rear end of pushrod 100 is slid into the slot 66 until the teeth 16 of shoe 14 engage the helical feature 20 of scroll wheel 18 which stops the inward insertion of shoe 14 into base 12. At this point, scroll wheel 18 is rotated in one rotational direction (the minus, unlock, reverse or retract direction) thereby causing the helical feature 20 of scroll wheel 18 to mesh with the teeth 16 of shoe 14. As the scroll wheel 18 is rotated the meshing engagement between the helical feature 20 and teeth 16 cause shoe 14 to pulled into the base 12. This inward movement continues until the rear wall 118 of plunger 102 engages the forward end of base 12 at slot 66 at which point shoe 14 is in a fully retracted position and the inline clamp system 10 is ready for use.

In an alternative arrangement the end of shoe 14 includes a step or stop feature that prevents the shoe 14 from being removed from clamp system 10. In this arrangement, the shoe 14 is inserted into base 12 prior to scroll wheel 18 and cap 22 being assembled.

In one arrangement, when assembled, such as is shown in FIGS. 22, 24, 25, 26A, 27, 28, 29 and 30A, when inline clamp system 10 is viewed from its front, along the length of extension of the shoe 14, the axis of rotation of scroll wheel 18 extends perpendicularly through the side-to-side center of main body 12, shoe 14 and scroll wheel 18. When inline clamp system 10 is viewed from its side, perpendicular to the length of extension of the shoe 14, the axis of rotation of scroll wheel 18 extends at an angle slightly less than perpendicular through the plane of extension of shoe 14, or said another way, when viewed from the side, the axis of rotation of scroll wheel 18 leans forward slightly from perpendicular (such as one degree to thirty degrees, or one degree to fifteen degrees, or one degree to ten degrees, or one degree to five degrees, or approximately four degrees, or any other angle or range therein). As such, the axis of rotation of scroll wheel 18 is both positioned at a perpendicular alignment to the length of extension of shoe 14 (when viewed from the front or back of inline clamp system 10) as well as at a slight angle to perpendicular (when viewed from the side of inline clamp system 10).

In Operation:

In operation, inline clamp system 10 is used to clamp a workpiece 220 by inserting post 78 into an opening 222 of a support surface 224, which with reference to FIGS. 31-35 is a workbench that includes a grid of openings 222 known as a bench dog grid of holes. Post 78 is inserted into opening 222 until the lower surface 40 of base 12 is in flat and flush engagement with the support surface 224. Alternatively, inline clamp system 10 is connected to support surface 224 by any other manner, method or means, such as by screwing inline clamp system 10 to support surface 224 or the like.

Once inline clamp system 10 is connected to support surface 224, scroll wheel 18 is rotated in a first rotational direction (the plus, lock, forward or extend direction). As the scroll wheel 18 is rotated in the first rotational direction, the helical feature 20 of scroll wheel 18 meshes with the teeth 16 in the upper wall 108 of pushrod 100 of shoe 14 on the forward side of the axis of rotation 84 that extends through the center of scroll wheel 18 while the helical feature 20 of scroll wheel 18 clears or does not engage the teeth 16 in the upper wall 108 of pushrod 100 of shoe 14 on the rearward side of the axis of rotation 84. As the scroll wheel 18 is rotated the meshing engagement between helical feature 20 and teeth 16 causes linear movement of the shoe 14.

As the scroll wheel 18 is rotated the lower surface of inward step 164 is in flat and flush and sliding engagement or close tolerances with the upper surface of upper step 58 of tower 52 of base 12; the interior surface of tower 162 is in flat and flush and sliding engagement or close tolerances with the exterior surface of tower 52 of base 12; the inward portion of lower surface 152 of scroll wheel 18 is in flat and flush and sliding engagement or close tolerances with the upper surface of platform 54 of base 12; and/or the outward portion of lower surface 152 of scroll wheel 18 is in flat and flush and sliding engagement or close tolerances with the upper surface 38 of base 12 at seamline 158. In one arrangement, to facilitate smooth and continuous and long use, the materials that form base 12, shoe 14, and scroll wheel 18 are formed of a self-lubricating material such as a nylon, glass filled nylon, a composite, a plastic, an ultra-high-molecular-weight (UHMW) material, or any other self-lubricating material that is strong, durable and provides smooth operation.

As the shoe 14 moves out of the base 12 the lower wall 110 of shoe 14 is in flat and flush and sliding engagement or close tolerances with the bottom surface 68 of slot 66; the sidewalls 106 of shoe 14 are in flat and flush and sliding engagement or close tolerances with sidewalls 72 of slot 66; the outward edges of upper wall 108 shoe 14 are in flat and flush and sliding engagement or close tolerances with lower surface of step 76 of slot 66; the exterior edges 114 of teeth 16 of shoe 14 are in flat and flush and sliding engagement or close tolerances with inward surface of step 76 of slot 66; and/or the upper surface of teeth 16 of shoe 14 are in flat and flush and sliding engagement or close tolerances with upper surface 70 of slot 66.

To facilitate faster deployment of shoe 14 initially the user grasps the exterior surface of tower 162 of scroll wheel 18 which due to its small diameter causes an increased speed of deployment. Rotation of the tower 162 of scroll wheel 18 is useful until the shoe 14 engages the workpiece 220. Increased pressure is applied to workpiece by using the mechanical advantage of the larger diameter of grip feature 156 connected to the exterior wall 154 of scroll wheel 18.

As the shoe 14 engages workpiece 220, plunger 102 applies pressure on workpiece 220 and forces workpiece 220 into engagement with one or more stops 226 which are positioned on the opposite or opposing side of workpiece 220 as inline clamp system 10. As the scroll wheel 18 is tightened the pressure generated between the engagement of plunger 102 and workpiece 220 and between stops 226 and workpiece 220 clamps workpiece 220 in place.

Figure 27:
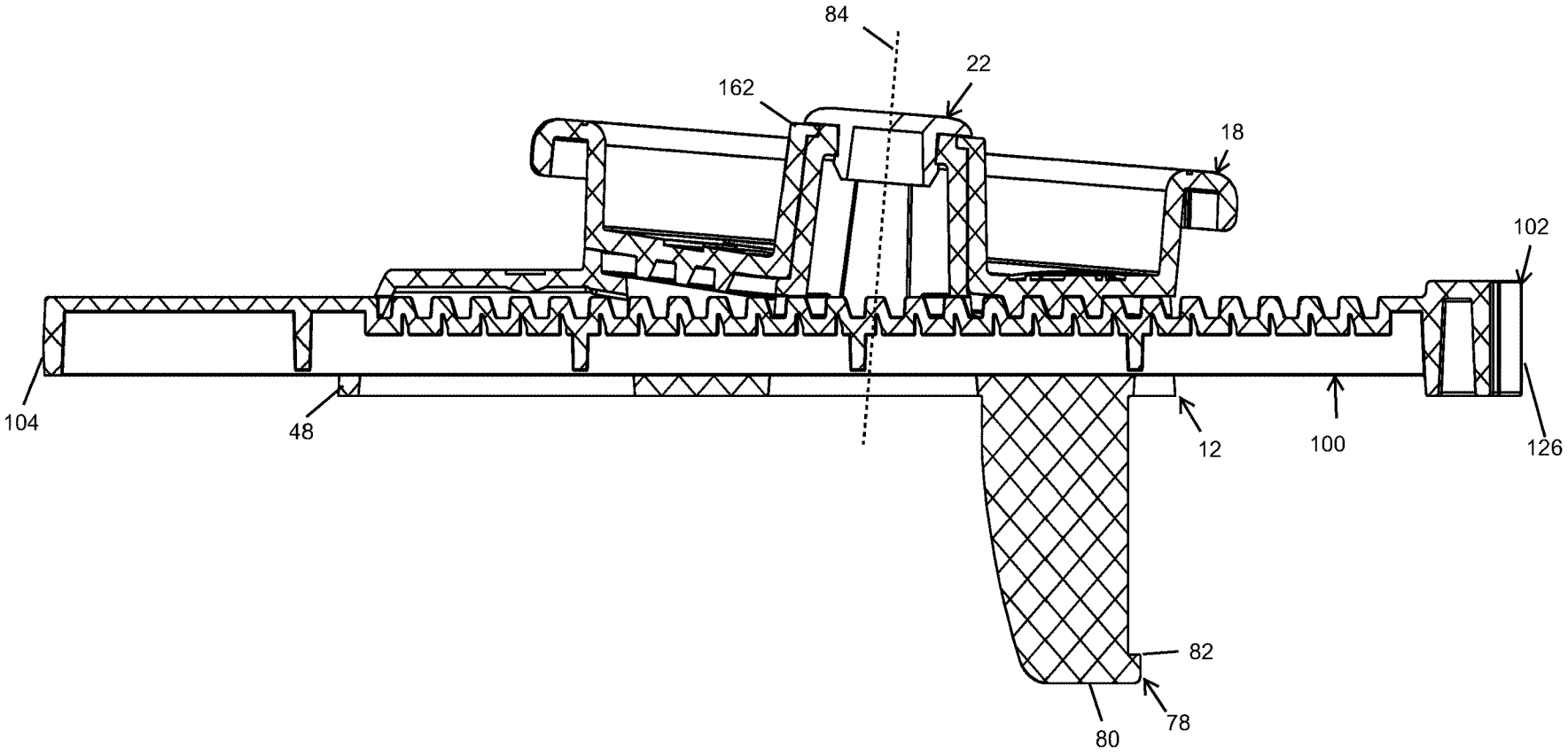
FIG. 27 is a close up view of FIG. 26A.

Notably, the center of the length of shoe 14 extends through the center of base 12 and axis of rotation 84. By aligning the center of shoe 14 with the center of base 12 and the axis of rotation this causes the pressure generated by the engagement between plunger 102 and workpiece 22 to also extend through the center of base 12. That is, the pressure generated by engagement of the workpiece 220 extends directly through the center of base 12, which causes the forces to be normal to or perpendicular to or approximately normal to or approximately perpendicular to the tangent point or tangent points of scroll wheel 18. Said another way, the force extends centrally through the direction of extension of shoe 14, which is perpendicular to the tangent point of the scroll wheel 18 where scroll wheel 18 engages teeth 16 (at the center of the engagement between scroll wheel 18 and shoe 14). By having the force enter inline clamp system 10 in a perpendicular manner (to the tangent point of scroll wheel 18) this means that there is no moment, or essentially no moment, that would cause the pushrod 100 to retract into base 12 after the scroll wheel 18 is tightened and there is no moment, or essentially no moment, that would cause the scroll wheel 18 to rotate back after the scroll wheel 18 is tightened. In addition, when the teeth 16 and helical feature 20 extend vertically and engage one another in a flush and flat vertical manner there is no force, or essentially no force, forcing the scroll wheel 18 away from main body 12 and shoe 14. This means that scroll wheel 18 and shoe 14 stay in place regardless of how tight the scroll wheel is tightened because there is no moment or force that causes retraction of shoe 14 or rotation of scroll wheel 18. Said another way, as is shown in FIGS. 27 and 28, at the center of pushrod 100 the helical feature 20 is in flat and flush engagement with teeth 16 of pushrod 100. As such, regardless of force being applied along the length of pushrod 100, there is no mechanism that can cause pushrod 100 to retract (other than a user induced rotation of scroll wheel 18). As such, once tightened, pushrod 100 stays in place. As such, there is no need for a secondary locking mechanism such as a set screw, clutch, locking mechanism or the like. This is unique among clamping mechanisms as essentially all other clamps require some sort of a locking mechanism to lock in place (which also requires unlocking to release the clamp).

In one arrangement, a locking taper arrangement is used for teeth 16 and helical feature 20. A locking taper is present onto two mating parts such that when the parts are mated the frictional forces are so great that the two parts will not rotate or move with respect to one another. As such no clamping forces are required to keep the parts joined, but considerable force is required to separate the items.

Applying this to the inline clamp system 10, when the scroll wheel 18 is tightened and plunger 102 applies force against workpiece 220, the frictional forces generated between the teeth 16 and helical feature 20 are greater than the force urging the scroll wheel 18 in the reverse direction due to the angle of engagement of the teeth 16 and helical feature 20. As such, when the scroll wheel 18 is tightened the scroll wheel 18 does not untighten itself. This means that no further locking or tightening is required (such as the use of a locking screw, spring loaded pin, cam, toggle or the like that prevents reverse rotation of scroll wheel 18. Instead, the user applies rotational force in the reverse direction to unlock the engagement between the teeth 16 and helical feature.

To untighten the in line clamp 10 the scroll wheel 18 is rotated in an opposite rotational direction and the shoe 14 retracts in the same or similar manner to the manner it extended (as is described herein).

Torque Setting Mechanism:

In one arrangement, inline clamp system 10 includes a torque setting mechanism. Torque setting mechanism is any device that indicates to a user the amount of torque applied or whether a predetermined or set amount of torque has been achieved.

Alternative Arrangement:

In an alternative arrangement, the component parts may have a completely different size, shape and design and/or look and feel, as compared to what is shown herein, while still employing the teaching described herein and meeting the limitations of the claims. In an alternative arrangement, base 12 may receive and/or include two or more scroll wheels 18 and associated shoes 14. This arrangement allows for applying a greater amount of clamping pressure across a greater area of a workpiece. This arrangement can also facilitate clamping while providing greater or more-precise angular alignment in applications where a high degree of precision is required. This arrangement with multiple scroll wheels 18 and multiple shoes 14 may also be incorporated with multiple posts 78 which may be used with a bench dog grid of holes which can be used to also provide precise alignment and spacing of the clamping system 10. In another arrangement, scroll wheel 18 is placed under all or a portion of main body 12 and under shoe 14. In another arrangement, all or a portion of scroll wheel 18 is placed within main body 12. In another arrangement, pushrod 100 of shoe 14 extends through scroll wheel 18.

In another arrangement, base 12 is attached to and/or formed within all of a portion of another component, such as a tool, a tool bench, a work surface, a table saw, a cross cut saw, a band saw, a router table, a drill press, a welding table, a jig or any other tool, table, fixture or other mechanical system or working arrangement. In this arrangement, when clamping is required, scroll wheel 18 is rotated and shoe 14 extends from and retracts into the base 12.

From the above discussion it will be appreciated that the inline clamp system and related method of use, presented herein improves upon the state of the art.

Specifically, the inline clamp system presented: provides improved functionality over prior art clamps; provides improved features over prior art clamps; is relatively inexpensive; is easy to use; is intuitive to use; is strong and robust; can be used in many applications; can be used with practically any support surface or workbench; provides unique functionality; is fast to use; is safe to use; saves time; has a compact size; has a low profile; has a long useful life; can be used to clamp straight workpieces as well as inside corners and outside corners; is high quality; improves efficiencies; is fun to use and improves the quality of the products made using the device, among countless other advantages and improvements.

It will be appreciated by those skilled in the art that other various modifications could be made to the device without parting from the spirit and scope of this disclosure. All such modifications and changes fall within the scope of the claims and are intended to be covered thereby.

What is claimed:

1. A clamp system, comprising:

a base;

a shoe operatively connected to the base;

the shoe configured to move between an extended position and a retracted position;

a scroll wheel operably connected to the base;

the scroll wheel having a helical feature;

wherein the helical feature operatively engages the shoe;

wherein rotation of the scroll wheel in a first rotational direction causes the shoe to move in a first linear direction, and rotation of the scroll wheel in a second rotational direction causes the shoe to move in a second linear direction, wherein the first linear direction is opposite the second linear direction.

2. A clamp system, comprising:

a base;

a shoe operatively connected to the base;

the shoe configured to move between an extended position and a retracted position;

a scroll wheel operably connected to the base;

wherein rotation of the scroll wheel in a first rotational direction causes the shoe to move in a first linear direction, and rotation of the scroll wheel in a second rotational direction causes the shoe to move in a second linear direction, wherein the first linear direction is opposite the second linear direction;

wherein the scroll wheel includes a helical feature that engages teeth of the shoe such that when the scroll wheel is rotated the helical feature of the scroll wheel meshes with the teeth of the shoe thereby causing linear movement of the shoe with respect to the base and the scroll wheel.

3. The system of claim 1, wherein the scroll wheel rotates around an axis of rotation, wherein the scroll wheel engages the shoe on a first side of the axis of rotation and wherein the scroll wheel is free of engagement with the shoe on a second side of the axis of rotation, wherein the first side of the axis of rotation is opposite the second side of the axis of rotation.

4. A clamp system, comprising:

a base;

a shoe operatively connected to the base;

the shoe configured to move between an extended position and a retracted position;

a scroll wheel operably connected to the base;

wherein rotation of the scroll wheel in a first rotational direction causes the shoe to move in a first linear direction, and rotation of the scroll wheel in a second rotational direction causes the shoe to move in a second linear direction, wherein the first linear direction is opposite the second linear direction;

the shoe having an elongated push rod, wherein the push rod includes a plurality of teeth, wherein the plurality of teeth are configured to operatively engage the scroll wheel.

5. A clamp system, comprising a base;

a shoe operatively connected to the base;

the shoe configured to move between an extended position and a retracted position;

a scroll wheel operably connected to the base;

wherein rotation of the scroll wheel in a first rotational direction causes the shoe to move in a first linear direction, and rotation of the scroll wheel in a second rotational direction causes the shoe to move in a second linear direction, wherein the first linear direction is opposite the second linear direction;

wherein the scroll wheel rotates around an axis of rotation, wherein when viewed from the side the axis of rotation is positioned at an angle to the plane that is less than perpendicular on one side.

6. A clamp system, comprising a base;

a shoe operatively connected to the base;

the shoe configured to move between an extended position and a retracted position;

a scroll wheel operably connected to the base;

wherein rotation of the scroll wheel in a first rotational direction causes the shoe to move in a first linear direction, and rotation of the scroll wheel in a second rotational direction causes the shoe to move in a second linear direction, wherein the first linear direction is opposite the second linear direction;

wherein the scroll wheel rotates around an axis of rotation, wherein when viewed from the side the axis of rotation is positioned at a slight angle to the plane, wherein the slight angle is between one degree and thirty degrees from perpendicular.

7. The system of claim 6, wherein the scroll wheel rotates around an axis of rotation, wherein when viewed from the side the axis of rotation is positioned at a slight angle to the plane, wherein the slight angle is between one degree and fifteen degrees from perpendicular.

8. The system of claim 6, wherein the scroll wheel rotates around an axis of rotation, wherein when viewed from the side the axis of rotation is positioned at a slight angle to the plane, wherein the slight angle is between one degree and five degrees from perpendicular.

9. The system of claim 1, wherein the scroll wheel rotates around an axis of rotation, wherein when viewed from the front the axis of rotation is perpendicular to the first linear direction and second linear direction.

10. The system of claim 1, wherein the scroll wheel includes a surface that engages the shoe, wherein the surface of the scroll wheel that engages the shoe is formed as a portion of a cone.

11. The system of claim 1, wherein the scroll wheel includes a surface that engages the shoe, wherein the surface of the scroll wheel that engages the shoe is cone shaped.

12. The system of claim 1, wherein the scroll wheel includes a surface that engages the shoe, wherein the surface of the scroll wheel that engages the shoe is cone shaped, wherein the cone shape angles between one degree and thirty degrees.

13. The system of claim 1, wherein the scroll wheel includes a surface that engages the shoe, wherein the surface of the scroll wheel that engages the shoe is cone shaped, wherein the cone shape angles between one degree and ten degrees.

14. The system of claim 1, wherein shoe includes a plunger positioned at an end of an elongated push rod, the plunger having a flat surface for engaging a flat surface of a workpiece, the plunger having a recess for engaging an outside corner of a workpiece, and the plunger having angled outside corners for receiving an inside corner of a workpiece.

15. The system of claim 1, wherein the base includes a post that is configured to connect the clamp system to an opening in a support surface.

16. The system of claim 1, wherein the base is formed of a single solid piece.

17. The system of claim 1, wherein the wheel is directly connected to the base.

18. The system of claim 1, wherein at least a portion of the shoe is positioned between the base and the scroll wheel.

19. The system of claim 1, wherein the scroll wheel is positioned on top of the base and the shoe.

20. The system of claim 1, wherein the shoe includes a plurality of teeth in a generally flat surface of an elongated push rod.

21. The system of claim 1, wherein when viewed from the front, the axis of rotation of the scroll wheel is perpendicular to the length of extension of the push rod, and wherein when viewed from the side, the axis of rotation of the scroll wheel is positioned at an angle slightly less than perpendicular on one side and slightly more than perpendicular on an opposite side.

22. A clamp system, comprising:

a base;

a shoe;

the shoe having an elongated push rod;

the elongated push rod having a plurality of teeth;

a scroll wheel;

the scroll wheel having a helical feature;

wherein the helical feature of the scroll wheel operatively engages the teeth of the push rod;

wherein rotation of the scroll wheel in a first rotational direction causes the shoe to move in a first linear direction, and rotation of the scroll wheel in a second rotational direction causes the shoe to move in a second linear direction, wherein the first linear direction is opposite the second linear direction.

23. The system of claim 22, wherein the scroll wheel rotates around an axis of rotation, wherein the scroll wheel engages the shoe on a first side of the axis of rotation and wherein the scroll wheel is free of engagement with the shoe on a second side of the axis of rotation, wherein the first side of the axis of rotation is opposite the second side of the axis of rotation.

24. The system of claim 22, wherein the shoe moves between the extended position and the retracted position in a plane, wherein the scroll wheel rotates around an axis of rotation, wherein when viewed from the side the axis of rotation is positioned at an angle to the plane that is less than a right angle on one side and more than a right angle on an opposite side.

25. The system of claim 22, wherein the scroll wheel includes a surface that engages the shoe, wherein the surface of the scroll wheel that engages the shoe is formed as a portion of a cone.

26. A clamp system, comprising:

a base;

a shoe;

the shoe having a plurality of teeth;

a scroll wheel;

the scroll wheel having a cone shaped surface;

the cone shaped surface having a helical feature;

wherein the helical feature of the cone shaped surface of the scroll wheel operatively engages the teeth of the shoe.

27. The system of claim 26, wherein rotation of the scroll wheel causes linear movement of the shoe.

28. The system of claim 26, wherein rotation of the scroll wheel in a first rotational direction causes the shoe to move in a first linear direction, and rotation of the scroll wheel in a second rotational direction causes the shoe to move in a second linear direction, wherein the first linear direction is opposite the second linear direction.

29. The system of claim 26, wherein the scroll wheel rotates around an axis of rotation, wherein the scroll wheel engages the shoe on a first side of the axis of rotation and wherein the scroll wheel is free of engagement with the shoe on a second side of the axis of rotation, wherein the first side of the axis of rotation is opposite the second side of the axis of rotation.

30. The system of claim 26, the shoe having an elongated push rod, wherein the plurality of teeth are positioned on the push rod.

31. The system of claim 26, wherein the shoe moves between an extended position and a retracted position in a plane, wherein the scroll wheel rotates around an axis of rotation, wherein when viewed from the side the axis of rotation is positioned at an angle to the plane that is less than a right angle on one side and more than a right angle on an opposite side.

32. The system of claim 26, wherein the shoe moves between an extended position and a retracted position in a plane, wherein the scroll wheel rotates around an axis of rotation, wherein when viewed from the front the axis of rotation is positioned at a right angle to the plane.

33. A scroll wheel for a clamp system, comprising:

a main body;

the main body having a generally circular exterior shape;

the main body having a cone shaped surface;

a helical feature positioned in the cone shaped surface.

34. The system of claim 33, wherein the cone shape angles between one degree and thirty degrees.

35. The system of claim 33, wherein the cone shape angles between one degree and ten degrees.

36. A method of clamping a workpiece, the steps comprising:

providing a clamp system, the clamp system having a base, a shoe and a scroll wheel, the shoe having a plurality of teeth and the scroll wheel having a helical feature, wherein the helical feature of the scroll wheel operatively engages the plurality of teeth of the shoe;

rotating the scroll wheel in a first rotational direction thereby moving the shoe in a first linear direction;

rotating the scroll wheel in a second rotational direction, the second rotational direction opposite the first rotational direction, thereby moving the shoe in a second linear direction, the second linear direction opposite the first linear direction.

37. A clamp system, comprising:

a base;

a shoe;

a scroll wheel;

the scroll wheel operatively connected to the shoe;

the scroll wheel having an axis of rotation;

wherein rotation of the scroll wheel causes linear movement of the shoe in a plane;

wherein the axis of rotation of the scroll wheel is positioned at an angle between perpendicular and thirty degrees to the plane of linear movement of the scroll wheel.

38. A clamp system, comprising:

a base;

a shoe;

the shoe having an elongated pushrod;

the elongated pushrod having a plurality of teeth;

a scroll wheel;

the scroll wheel having a helical feature;

wherein the shoe is positioned between at least a portion of the base and the scroll wheel;

wherein the scroll wheel is positioned on top of the base and the shoe;

wherein rotation of the scroll wheel causes linear movement of the shoe in a plane.

39. A clamp system, comprising:

a base;

a shoe;

the shoe having a plurality of teeth;

a scroll wheel;

the scroll wheel having a helical feature;

wherein the helical feature of the scroll wheel is operatively engaged with the teeth of the shoe;

wherein rotation of the scroll wheel causes linear movement of the shoe;

wherein the scroll wheel engages the shoe on a first side of the axis of rotation of the scroll wheel and wherein the scroll wheel is free of engagement with the shoe on a second side of the axis of rotation of the scroll wheel, wherein the first side of the axis of rotation is opposite the second side of the axis of rotation.

40. The system of claim 5, wherein the one side is a forward side of the axis of rotation.

41. The system of claim 5, wherein the one side is a reward side of the axis of rotation.

* * * * *